US006876824B2

(12) United States Patent
Maeda

(10) Patent No.: US 6,876,824 B2
(45) Date of Patent: Apr. 5, 2005

(54) IMAGE FORMING APPARATUS AND SHEET SETTING CONTROL METHOD

(75) Inventor: Yuichiro Maeda, Ibaraki (JP)

(73) Assignee: Canon Kabushiki Kaisha (JP)

( * ) Notice: Subject to any disclaimer, the term of this patent is extended or adjusted under 35 U.S.C. 154(b) by 0 days.

(21) Appl. No.: 10/421,631

(22) Filed: Apr. 23, 2003

(65) Prior Publication Data

US 2004/0037581 A1 Feb. 26, 2004

(30) Foreign Application Priority Data

Apr. 23, 2002 (JP) ..... 2002-121002
Mar. 18, 2003 (JP) ..... 2003-073745

(51) Int. Cl.[7] ..... G03G 15/00
(52) U.S. Cl. ..... 399/82
(58) Field of Search ..... 399/45, 82, 83, 399/85, 86, 361, 365

(56) References Cited

U.S. PATENT DOCUMENTS 4,998,145 A * 3/1991 Haneda et al. ..... 399/14

FOREIGN PATENT DOCUMENTS

JP 9-68896 A 3/1997
JP 9-160444 A 6/1997
JP 10-126611 A 5/1998
JP 2001-159391 A 6/2000

* cited by examiner

*Primary Examiner*—Hoang X Ngo
(74) *Attorney, Agent, or Firm*—Rossi, Kimms & McDowell

(57) ABSTRACT

There is provided an image forming apparatus that is capable of reducing the burden on the user and improving the usability by eliminating the necessity of performing such a complicated operation as to input the lengths of a free size sheet in the vertical and horizontal directions thereof in forming a black-and-white image on the free size sheet, and enable prompt processing even when there are a large number of free size sheets on which black-and-white images are to be formed. An operating section 219 displays screens for designating an automatic color selection mode, a color mode, or a black-and-white mode, selecting a regular size sheet or a free size sheet, and setting the lengths of a free size sheet in the vertical and horizontal directions thereof, and a main body controller 200 provides control to enable the setting as to the lengths of a free size sheet in the vertical and horizontal directions thereof when the free size sheet has been selected and the color mode has been designated, and to disable the setting as to the lengths of a free size sheet in the vertical and horizontal directions when the free size sheet has been selected and the black-and-white mode has been designated.

18 Claims, 17 Drawing Sheets

IMAGE FORMING APPARATUS AND SHEET SETTING CONTROL METHOD

BACKGROUND OF THE INVENTION

1. Field of the Invention

The present invention relates to an image forming apparatus and a sheet setting control method that can be suitably applied to a copying machine or the like, which has a color mode in which a color image is outputted and a black-and-white mode in which a black-and-white image is outputted.

2. Description of the Related Art

In a conventional image forming apparatus capable of outputting a color image, in the case where a free size sheet is used as a recording medium on which an image is formed, the user has to input the lengths of the free size sheet in the vertical and horizontal directions thereof for the following reasons. If the sheet size is unknown, in the case where the size of an image to be outputted exceeds the sheet size, surplus toner beyond the sheet size scatters in the apparatus to form an unfavorable image or cause failure of the apparatus. In particular, if the mage forming apparatus is a 1D (drum) type image forming apparatus that forms a color image using one photosensitive body, image formation takes more time, and hence the scatter of toner in the apparatus is likely to cause troubles.

A conventional image forming apparatus capable of outputting a black-and-white image also has the problem that toner may scatter for the reasons stated above, but this problem occurs only with a low possibility because the formation of a black-and-white image takes less time as compared with a color image, and the scatter of toner usually has a smaller effect on the image quality of a black-and-white image than on that of a color image. Therefore, the conventional image forming apparatus capable of outputting a black-and-white image usually does not force the user to set the size of a free size sheet. On the other hand, a conventional image forming apparatus capable of outputting both a color image and a black-and-white image requires the user to input the lengths of a sheet in the vertical and horizontal directions even when a black-and-white image is formed on a free size sheet.

The above described prior art, however, has the following problems. Since the image forming apparatus capable of outputting both a color image and a black-and-white image requires the user to input the lengths of a sheet in the vertical and horizontal directions even when a black-and-white image is formed, the necessity of performing a complicated inputting operation imposes a heavy burden on the user who has more opportunities to form a black-and-white image than a color image (for example, Japanese Laid-Open Patent Publication (Kokai) Nos. 2000-159391, 10-126611, 09-068896 and 09-160444).

SUMMARY OF THE INVENTION

It is therefore a first object of the present invention to provide an image forming apparatus and a sheet setting control method that are capable of reducing the burden on the user and improving the usability by eliminating the necessity of performing such a complicated operation as to input the lengths of a free size sheet in the vertical and horizontal directions thereof in forming a black-and-white image on the free size sheet, and enable prompt processing even when there are a large number of free size sheets on which black-and-white images are to be formed.

It is a second object of the present invention to provide an image forming apparatus and a sheet setting control method that are capable of eliminating the necessity of performing a complicated operation in forming a black-and-white image on a free size sheet while satisfying the requirements for the improved quality of a black-and-white image from the user who puts more emphasis on the quality of a black-and-white image than on the improvement of the operability.

To attain the first object, in a first aspect of the present invention, there is provided an image forming apparatus comprising a color image forming section that forms a color image on a sheet, a black-and-white image forming section that forms a black-and-white image on a sheet, and a controller, wherein the controller is operable when a color image is formed on a free size sheet, for causing the color image forming section to carry out image formation according to a setting as to lengths of the free size sheet in vertical and horizontal directions thereof, and is operable when a black-and-white image is formed on a free size sheet, for causing the black-and-white image forming section to carry out image formation even if no setting as to the lengths of the free size sheet in vertical and horizontal directions thereof is made.

Preferably, the image forming apparatus according to the first aspect comprises a mode designating section that designates a color mode in which a color image is formed or a black-and-white mode in which a black-and-white image is formed, a sheet selecting section that selects one of a regular size sheet and a free size sheet, and a free size setting section that sets the lengths of the free size sheet in vertical and horizontal directions thereof, and wherein the controller provides control to enable the free size setting section when the free size sheet has been selected and the color mode has been designated, and to disable the free size setting section when the free size sheet has been selected and the black-and-white mode has been designated.

To attain the first object, in a second aspect of the present invention, there is provided a sheet setting control method for an image forming apparatus capable of forming a color image and a black-and-white image, comprising the steps of carrying out image formation according to a setting as to lengths of a free size sheet in vertical and horizontal directions thereof when a color image is formed on the free size sheet, and carrying out image formation even if no setting as to the lengths of the free size sheet in the vertical and horizontal directions thereof is made when a black-and-white image is formed on the free size sheet.

Preferably, the sheet setting control method according to the first aspect comprises the steps of enabling a free size setting function of setting the lengths of a free size sheet in vertical and horizontal directions thereof when the free size sheet has been selected and a color mode in which a color image is formed has been designated, and disabling the free size setting function when the free size sheet has been selected and a black-and-white mode in which a black-and-white image is formed has been designated.

To attain the first object, in a third aspect of the present invention, there is provided an image forming apparatus, which comprises, in addition to the component elements of the above described preferred form of the image forming apparatus according to the first aspect, a determining section that determines whether an original is a color original or a black-and-white original, and wherein the mode designating section is capable of designating an automatic color selection mode in which whether image formation is carried out in the color mode or in the black-and-white mode is determined for each sheet, the controller provides control to cause the color image forming section to form a color image when the automatic color selection mode has been designated and it has been determined that the original is the color original, to cause the black-and-white image forming section to form a black-and-white image when the automatic color selection mode has been designated and it has been determined that the original is the black-and-white original, and to enable the free size setting section at a time point it is determined that the original is the color original when the automatic color selection mode has been designated and the free size sheet has been selected.

Preferably, the image forming apparatus according to the third aspect comprises an in-automatic color selection mode specifying section operable when the automatic color selection mode has been designated and the free size sheet has been selected, for specifying whether the free size setting section is to be necessarily enabled before image formation or is to be enabled at a time point it is determined that the original is the color original.

To attain the first object, in a fourth aspect of the present invention, there is provided a sheet setting control method which, in addition to the steps of the above described preferred form of the sheet setting control method according to the second aspect, comprises the steps of forming a color image when an automatic color selection mode in which whether image formation is to be carried out in the color mode or in the black-and-white mode is determined for each sheet has been designated and it has been determined that an original is a color original, forming a black-and-white image when the automatic color selection mode has been designated and it has been determined that the original is a black-and-white original, and enabling the free size setting function at a time point it is determined that the original is the color original when the automatic color selection mode has been designated and the free size sheet has been selected.

Preferably, the sheet setting control method according to the fourth aspect comprises the step of specifying whether the free size setting function is to be necessarily enabled before image formation or is to be enabled at a time point it is determined that the original is the color original when the automatic color selection mode has been designated and the free size sheet has been selected.

To attain the first object, in a fifth aspect of the present invention, there is provided an image forming apparatus, which comprises, in addition to the component elements of the above described preferred form of the image forming apparatus according to the first aspect, an original size detecting section that detects a size of an original, and wherein the sheet selecting section selects the free size sheet when the size of the original is detected as being any other size than a regular size.

Preferably, in the image forming apparatus according to the fifth aspect, the original size detecting section is further capable of detecting lengths of the original in vertical and horizontal directions thereof, and wherein the controller provides control to display a screen for setting the lengths of the free size sheet in the vertical and horizontal directions thereof and perform image formation according to settings and confirmation made by a user when the original size has been detected as being any other size than the regular size.

To attain the first object, in a sixth aspect of the present invention, there is provided a sheet setting control method, which comprises, in addition to the steps of the above described preferred form of the sheet setting control method according to the second aspect, comprises the step of selecting the free size sheet when a size of the original is detected as being any other size than a regular size.

Preferably, the sheet setting control method according to the sixth aspect comprises the step of displaying a screen for setting the lengths of the free size sheet in the vertical and horizontal directions thereof and carrying out image formation according to settings and confirmation made by a user when the size of the original has been detected as being any other size than the regular size.

To attain the first object, in a seventh aspect of the present invention, there is provided an image forming apparatus, which comprises, in addition to the component elements of the preferred form of the image forming apparatus according to the first aspect, a sheet detecting section that detects whether a sheet is present, and a sheet size calculating section that calculates a sheet size based on a detection result obtained by the sheet detecting section, and wherein, in a case where image formation is carried out on the free size sheet, the controller provides control such that the image formation is carried out according to the set lengths of the free size sheet in the vertical and horizontal directions thereof when the free size setting section has been enabled, and such that the sheet detecting section carries out sheet detection, the sheet size calculating section calculates the sheet size of a first sheet being fed, and the image formation is carried out on second and subsequent sheets according to the calculated sheet size when the free size setting section has been disabled.

To attain the first object, in an eighth aspect of the present invention, there is provided a sheet setting control method, which comprises, in addition to the steps of the above described preferred form of the sheet setting control method according to the second aspect, the steps of carrying out image formation according to the set lengths of the free size sheet in the vertical and horizontal directions thereof when the free size setting function has been enabled, and carrying out sheet detection, calculating a sheet size of a first sheet being fed, and carrying out image formation on second and subsequent sheets according to the calculated sheet size when the free size setting function has been disabled, in a case where image formation is carried out on the free size sheet.

To attain the second object, in a ninth aspect of the present invention, there is provided an image forming apparatus, which comprises, in addition to the component elements of the above described preferred form of the image forming apparatus according to the first aspect, an in-black-and-white mode specifying section operable when image formation is carried out on the free size sheet in the black-and-white mode designated by the mode designating section, for specifying whether the lengths of the free size sheet in the vertical and horizontal directions are to be set, and wherein the controller provides control to disable the free size setting section when the in-black-and-white mode specifying section specifies that the lengths of the free size sheet in the vertical and horizontal directions are not to be set, and to enable the free size setting section when the in-black-and-white mode specifying section specifies that the lengths of the free size sheet in the vertical and horizontal directions are to be set.

To attain the second object, in a tenth aspect of the present invention, there is provided a sheet setting control method, which comprises, in addition to the steps of the above described preferred form of the sheet setting control method according to the second aspect, the steps of enabling the free size setting function when an in-black-and-white mode specifying function of specifying whether the lengths of the free size sheet in vertical and horizontal directions thereof are to be set when an image is formed on the free size sheet in the black-and-white mode is disabled in a case where the free size sheet has been selected and the black-and-white mode has been designated, and enabling the free size setting function when the in-black-and-white mode designating function is enabled.

According to the above described first through tenth aspects of the present invention, in the case where an image is formed on a free size sheet in a black-and-white mode, an image can be formed even if the lengths of the free size sheet in the vertical and horizontal directions thereof are not set. This eliminates the necessity of performing such a complicated operation to input the lengths of a free size sheet in the vertical and horizontal directions thereof in forming a black-and-white image on the free size sheet, thus reducing the burden on the user and improving the usability. Further, even if there are a large number of free size sheets on which black-and-white images are to be formed, there is no necessity of performing the complicated operation, thus enabling prompt processing. Further, the image forming apparatus according to the present invention can satisfy the requirements for the improved quality of a black-and-white image from the user who puts emphasis on the quality of a black-and-white image.

The above and other objects, features, and advantages of the invention will become more apparent from the following detailed description taken in conjunction with the accompanying drawings.

DETAILED DESCRIPTION OF THE PREFERRED EMBODIMENTS

Figure 1:
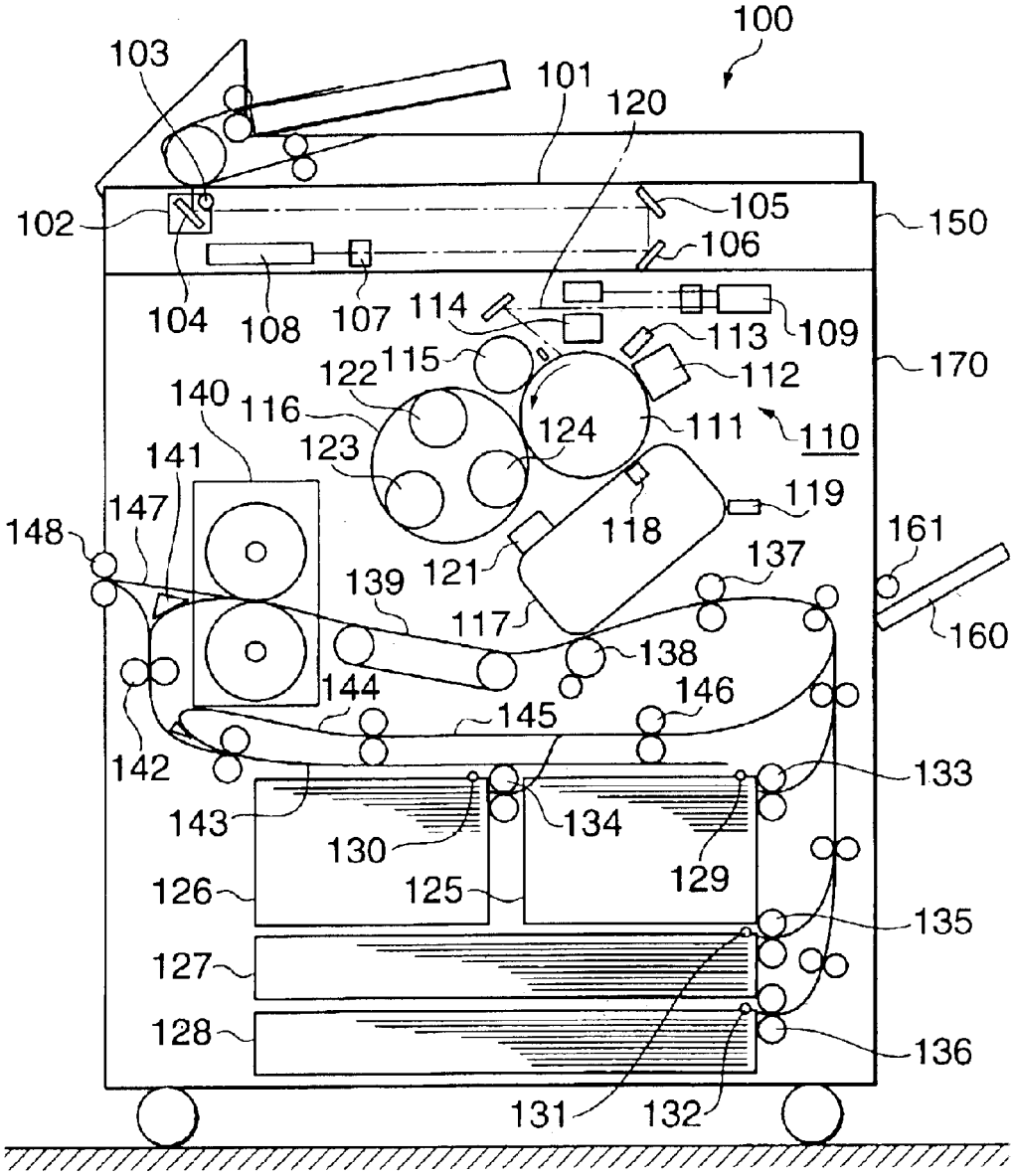
FIG. 1 is a schematic sectional diagram showing the construction of an image forming apparatus according to an embodiment of the present invention.

The present invention will now be described in detail with reference to the drawings showing preferred embodiments thereof. In the drawings, elements and parts which are identical throughout the views are designated by identical reference numerals, and duplicate description thereof is omitted.

FIG. 1 is a sectional view schematically showing an image forming apparatus according to a first embodiment of the present invention. The image forming apparatus 100 according to the present embodiment is comprised of a digital color image reader section 150 (hereinafter referred to as "the reader section 150") that constitutes the upper part of the main body of the image forming apparatus 100, and a digital color image printer section 170 (hereinafter referred to as "the printer section 170") that constitutes the lower part of the main body. The image forming apparatus 100 has a color image formation mode (hereinafter referred to as "the color mode") in which a color image is outputted, a black-and-white image formation mode (hereinafter referred to as "the black-and-white mode") in which a black-and-white image is outputted, and an automatic color selection mode (hereinafter referred to as "the ACS mode") in which whether an image is to be formed in the color mode or in the black-and-white mode is automatically determined for each original.

The reader section 150 is comprised of an original stand glass 101 serving as a stand on which an original is mounted, a scanner 102 comprised of an original illumination lamp 103 and a scanning mirror 104, optical elements such as scanning mirrors 105 and 106 and a lens 107, and a full-color image sensor section 108 (hereinafter referred to as "the image sensor section 108"). The scanner 102 is driven by a motor, not shown, to scan the original forward and backward in a predetermined direction. The original illumination lamp 103 emits light to irradiate the original. The scanning mirrors 104 to 106 and the lens 107 guide an image, which is formed by light emitted from the original illumination lamp 103 and reflected on the original, to the image sensor section 108. The image sensor section 108 is formed integrally with an RGB three-color separation filter, and is comprised of a CCD sensor.

When the scanner 102 scans the original mounted on the original stand glass 101, the image formed by light emitted from the original illumination lamp 103 and reflected on the original is passed through the lens 107 via the scanning mirrors 104 to 106 and formed on the CCD sensor of the image sensor section 108 to acquire a color separation image analog signal. The color separation image analog signal is digitalized through an amplifier circuit of a CCD 201, described later with reference to FIG. 2. It should be noted that an original size sensor 220 (refer to FIG. 2) capable of detecting the size of an original (such as A3, A4, B4, B5, and so forth) and the lengths of a sheet in the vertical and horizontal directions thereof is disposed in the reader section 150.

In the reader section 150, one original is scanned first to determine whether the original is a color one or a black-and-white one, and then the original is scanned again to acquire image data thereof, so that whether an image is to be formed in the color mode or in the black-and-white mode can be automatically determined.

Whether an image is to be formed in the color mode or in the black-and-white mode original can be determined not only by scanning the original twice as described above but also by a variety of other methods. For example, whether an original is a color one or a black-and-white one is determined by skimming the original during feeding onto the original stand glass 101, and then an image on the original is scanned by fixed reading. Alternatively, whether an original is a color one or a black-and-white one can be determined using a CCD for determination, which is additionally provided at a location upstream of the original reading CCD in the original feeding direction. The present embodiment is not limited to any of these methods.

The printer section 170 is comprised of an image forming section 110. The image forming section 110 is comprised of an exposure controller 109, a photosensitive drum 111, a cleaning device 112, a pre-exposure lamp 113, a primary electrifier 114, a black color developing device 115, a rotary developing unit 116, an intermediate transfer belt 117, and a primary transfer electrifier 118. The exposure controller 109 is comprised of a laser emitter, a polygon scanner, and so forth. The exposure controller 109 irradiates a photosensitive drum 111 as an image carrier with a laser light 120, which is modulated according to an image signal which is converted into an electric signal by the image sensor section 108 of the reader section 150 and subjected to predetermined image processing.

The photosensitive drum 111 is rotatively driven by a motor, not shown, in a direction indicated by the arrow in FIG. 1, whereby the photosensitive drum 111 is made unelectrified by the pre-exposure lamp 113 and is electrified uniformly by the primary electrifier 114 to a desired potential, and is then irradiated with the laser light 120 emitted from the exposure controller 109 so that an electrostatic latent image is formed on the surface of the photosensitive drum 111. The electrostatic latent image formed on the photosensitive drum 111 is developed by a predetermined developing device to form a toner image on the photosensitive drum 111. The rotary developing unit 116 is comprised of developing devices 122, 123, and 124 corresponding to yellow, magenta, and cyan, respectively.

To develop a color image area in the case where a color image is formed when a toner image is formed on the photosensitive drum 111, the rotary developing unit 116 is rotated by a motor, not shown, such that a predetermined one of the developing devices 122 to 124 is selectively made closer to the photosensitive drum 111 according to each of the separated colors to be developed. On the other hand, to develop a black image area, the black-and-white developing device 115 disposed in the vicinity of the photosensitive drum 111 is used. To form a black-and-white image, only the black color developing device 115 is used.

The toner image developed on the photosensitive drum 111 is transferred to the intermediate transfer belt 117 by a high pressure applied by the primary transfer electrifier 118. To form a color image, toner images of four colors are transferred on the intermediate transfer belt 117 in a manner being superposed upon one another, and to form a black-and-white image, only a black-color toner image is transferred on the intermediate transfer belt 117. Incidentally, in the present embodiment, if a recording material (sheet) whose length is ½ or less of the circumference of the intermediate transfer belt 117 is used, images can be simultaneously formed in regions on the intermediate transfer belt 117, which correspond to two sheets of the recording material. After the primary transfer, the cleaning device 112 removes residual toner from the surface of the photosensitive drum 111, and the photosensitive drum 111 is then subjected again to image formation.

The printer section 170 is further comprised of a secondary transfer electrifier 138, a sheet conveying belt 139, a fixing device 140, a sheet discharge flapper 141, a right cassette deck 125, a left cassette deck 126, an upper cassette deck 127, and a lower cassette deck 128. The cassette decks 125 to 128 store sheets on which toner images formed on the intermediate transfer belt 117 in the image forming section 110 are to be transferred.

A sheet stored in the right cassette deck 125 is fed by a pickup roller 129 and a sheet feeding roller 133, and conveyed by resist rollers 137 to a secondary transfer position where a toner image formed on the intermediate transfer belt 117 is transferred onto the sheet. Similarly, a sheet stored in the left cassette deck 126 is fed by a pickup roller 130 and sheet feeding rollers 134, a sheet stored in the upper cassette deck 127 is fed by a pickup roller 131 and sheet feeding rollers 135, a sheet stored in the lower cassette deck 128 is fed by a pickup roller 132 and sheet feeding rollers 136, and each of the sheets fed from the cassette decks 125 to 128 is conveyed by the resist rollers 137 to the secondary transfer position.

Figure 17:
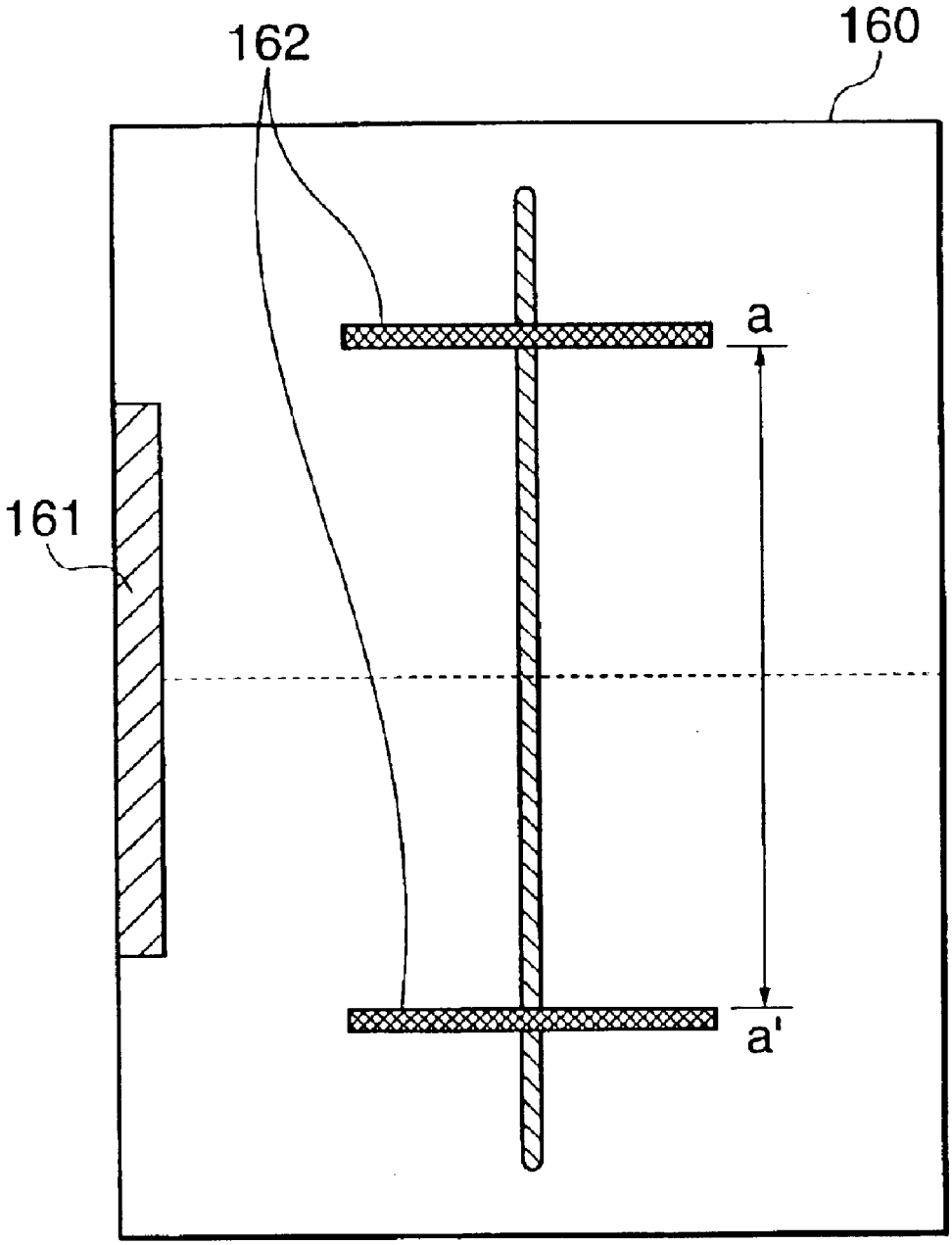
FIG. 17 is a diagram schematically showing the multi manual feed cassette.

It is possible to feed a sheet from a multi manual feed cassette 160. To form an image on an OHP sheet, a free size sheet, or the like, which is used with a low frequency, the sheet is fed from the multi manual feed cassette 160. It should be noted that the multi manual feed cassette 160 is provided with a guide 162 (FIG. 17) for feeding a sheet straightforward to the printer section 170, and a sensor, not shown, which detects the width of the guide 162 to detect the width of a sheet (the length of a sheet in the main scanning direction).

Further, the approximate size of a sheet, which is being fed, in the sheet feeding direction can be derived from a time period during which a sheet sensor 221 (refer to FIG. 2) disposed in front of the resist rollers 137 detects the sheet, and therefore, when a free size sheet is fed, it is possible to calculate the approximate lengths of the sheet in the vertical and horizontal directions. If free size sheets are fed without the size thereof being designated when black-and-white images are formed, the size of the sheet fed first is calculated, and thereafter a laser unit 204 in FIG. 2, described later, controls the formation of the images on the second and subsequent sheets according to the calculated size such that unnecessary parts (if exist) of images data are not exposed.

In the image forming section 110, after the toner image is transferred onto the intermediate transfer belt 117, the sheet conveyed from any cassette deck to the resist rollers 137 is conveyed to the secondary transfer roller 138 disposed at the secondary transfer position so that the secondary transfer on the sheet is carried out. After the end of the secondary transfer, the cleaning device 121 removes residual toner from the intermediate transfer belt 117, and the intermediate transfer belt 117 is then subjected again to image formation. In the present embodiment, a gap between the intermediate transfer belt 117 and the secondary transfer belt 138 can be set as desired by operating an eccentric cam, not shown, in desired timing. Assuming that a color image is formed, the gap is formed when toner images in a plurality of colors are transferred onto the intermediate transfer belt 117 in a manner being superposed one upon another, but no gap is formed when the toner images are transferred onto the sheet. Further, in standby state or when power is off, the gap is formed.

After the end of the secondary transfer, the sheet passes through the secondary transfer roller 138, and is conveyed by the conveying belt 139 and pressurized and heated by the heating roller type fixing device 140 so that the toner transferred onto the sheet can be fixed. The sheet is then discharged from the image forming apparatus 100 by discharge rollers 148.

Figure 2:
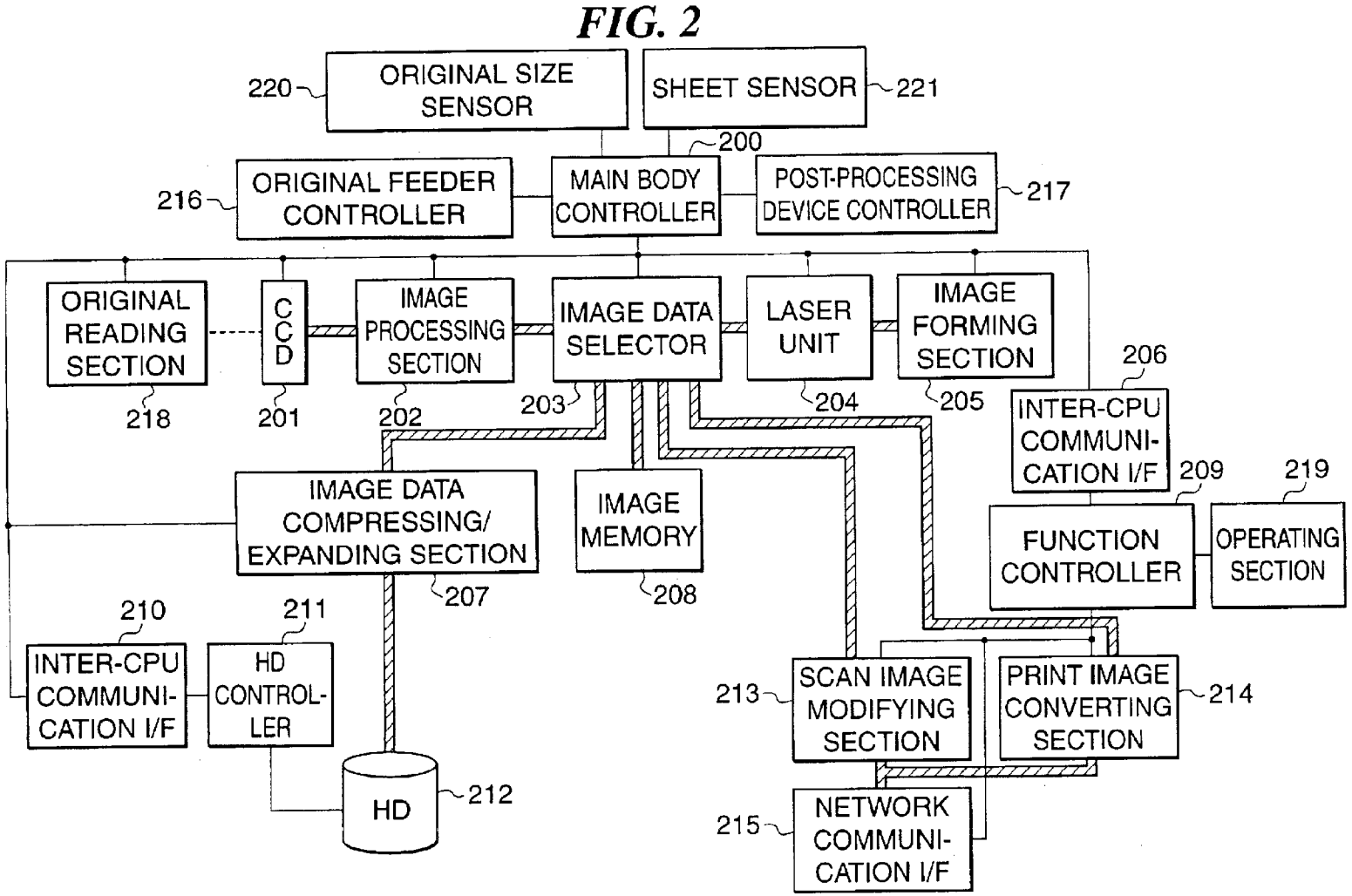
FIG. 2 is a block diagram showing the configuration of a control circuit of the image forming apparatus in FIG. 1.

FIG. 2 is a block diagram showing the configuration of a control circuit of the image forming apparatus 100 in FIG. 1. The control circuit of the image forming apparatus 100 is comprised of a main body controller 200, the CCD 201, an image processing section 202, an image data selector 203, the laser unit 204, an image forming section 205, an inter-CPU communication interface (I/F) section 206, and an image data compressing/expanding section 207. The main body controller 200 provides control to drive the reader section 150 (image reading section), the image forming section 110 of the printer section 170, and so forth provided in the image forming apparatus 100. The main body controller 200 is comprised of a CPU, a RAM that provides a work area for the CPU, and a ROM that stores control programs executed by the CPU.

It should be noted that the ROM stores control programs for executing operation modes, described later, and control programs for controlling the overall operation of the image forming apparatus 100. For example, the ROM stores a control program for causing the image processing section 202 to convert image data read by the CCD 201 into predetermined image data, and a control program for switching the path of image data received by the image data selector 203 so that the image data can be transmitted to any selected one of the laser unit 204, the image data compressing/expanding section 207, an image memory 208, described later, and a function controller 209, described later. The ROM also stores a control program for causing an original feeder controller 216, described later, to feed an original as described above, a control program for executing control in a predetermined mode set in a post processing device controller 217, a control program for performing predetermined processing on image data, and a control program for providing control to cause the image forming apparatus 100 to execute control in an index sheet insert mode or the like.

The CCD 201 is provided in the reader section 150 (image reading section), which is comprised of the original stand glass 101, the original illumination lamp 103, the optical system, and so forth. The CCD 201 captures light reflected from an original among light radiated by the original illumination lamp 103, performs photoelectric conversion of the captured light, and outputs image data obtained by the photoelectric conversion. The image processing section 202 performs predetermined image processing on the image data outputted from the CCD 201. It should be noted that the predetermined image processing is carried out according to an image processing mode, which is set through the operation of an operating section 219. The image data selector 203 is connected to the laser unit 204, image data compressing/expanding section 207, image memory 208, and function controller 209 via an image data bus. The image data selector 203 receives control information from the main body controller 200, and determines a location to which the image data is inputted according to the received control information.

The laser unit 204 performs laser-exposure on the photosensitive drum 111 provided in the image forming section 110. As described above, in the image forming section 110, an image formed on the photosensitive drum 111 by the laser exposure and the developing process is transferred onto the intermediate transfer belt 117, and then transferred onto a sheet. The inter-CPU communication I/F section 206 transmits and receives control information to and from the main body controller 200 and the function controller 209. The image data compressing/expanding section 207 operates when image data outputted from the image data selector 203 is accumulated in a HD (hard disk) 212 as a mass storage non-volatile memory, to compresses the image data so as to save the space occupied by the image data in the HD 212. Further, when transferring the compressed image data from the HD 212 to the image data selector 203, the image data compressing/expanding section 207 expands the image data into the original uncompressed image data.

The control circuit of the image forming apparatus 100 is further comprised of the image memory 208, the function control circuit 209, an inter-CPU communication interface (I/F) section 210, a HD (hard disk) controller 211, the HD (hard disk) 212, a scan image modifying section 213, a print image converting section 214, a network communication interface (I/F) section 215, the original feeder controller 216, the post processing device controller 217, an original reading controller 218, and the operating section 219. The image memory 208 temporarily stores image data transmitted from the image data selector 203. The stored image data is transmitted to the image data selector 203 as the need arises. Note that the image memory 208 is comprised of a volatile memory. The function controller 209 communicates with the main body controller 200, and transmits image data control information received from the main body controller 200 to the scan image modifying section 213 and the print image converting section 214.

The print image converting section 214 receives print image data from the network communication I/F 215, converts the received image data into predetermined image data, and transmits the resulting image data to the image data selector 203. The function controller 209 transmits control information, which is inputted via the operating section 219 and is intended for controlling the overall operation of the image forming apparatus 100, to the main body controller 200 via the inter-CPU communication I/F section 206. The inter-CPU communication I/F section 210 provides interface for exchanging control information relating to image data stored in the HD 212 between the HD controller 211 and the main body controller 200.

The HD controller 211 controls the HD 212 such that image data transmitted from the image data compressing/expanding section 207 is stored in the HD 212. Further, the HD controller 211 controls the HD 212 such that the stored image data is read out from the HD 212 and transmitted to the image data compressing/expanding section 207. It should be noted that control information required for the HD controller 211 to control the HD 212 is received from the body controller 200 via the inter-CPU communication I/F section 210. The HD 212 is comprised of a non-volatile RAM.

The scan image modifying section 213 converts image data transmitted form the image data selector 203 into image data written in PDL (Page Description Language), and transfers the resulting image data to a host computer, not shown, which is connected to the image forming apparatus 100 via the network communication I/F section 215. Incidentally, the host computer is capable of performing processing on image data written in PDL. The scan image modifying section 213 also modifies the image data written in PDL received from the host computer into image data in a format suitable for being printed out by the image forming section 110. It should be noted that the scan image modifying section 213 performs the above modification under the control of the main body section 200.

The network communication I/F section 215 provides interface for connecting the image forming apparatus 100 to a network. The network communication I/F section 215 transmits and receives image data and control information to and from equipment (such as a computer) connected to the network according to a predetermined communication protocol.

The original feeder controller 216 controls an original feeder, not shown, according to control information transmitted from the main body controller 200. The post processing device controller 217 controls a post processing device, not shown, according to control information transmitted from the main body controller 200. The original reading controller 218 controls an optical unit drive, not shown, according to control information transmitted from the main body controller 200. Incidentally, the optical unit drive drives an optical unit. The optical unit is equipped with an original irradiating means (the original illumination lamp 103), an optical means (the scanning mirrors 104 to 106 and the lens 107), and so forth, and irradiates the original using these means. Driving the optical unit causes an image recorded on an original to be formed on the CCD 201.

The operating section 219 is used by the user to input information to the image forming apparatus 100. The user is informed of the operating condition of the image forming apparatus 100 via the operating section 219. It should be noted that key information inputted via keys provided on the operating section 219 is transmitted to the function controller 209. The function controller 209 then analyzes a command represented by the key information, and transmits the analyzed command to the main body controller 200 via the inter-CPU communication I/F section 206, so that the control information inputted by the user can be transmitted to the main body controller 200.

Figure 3:
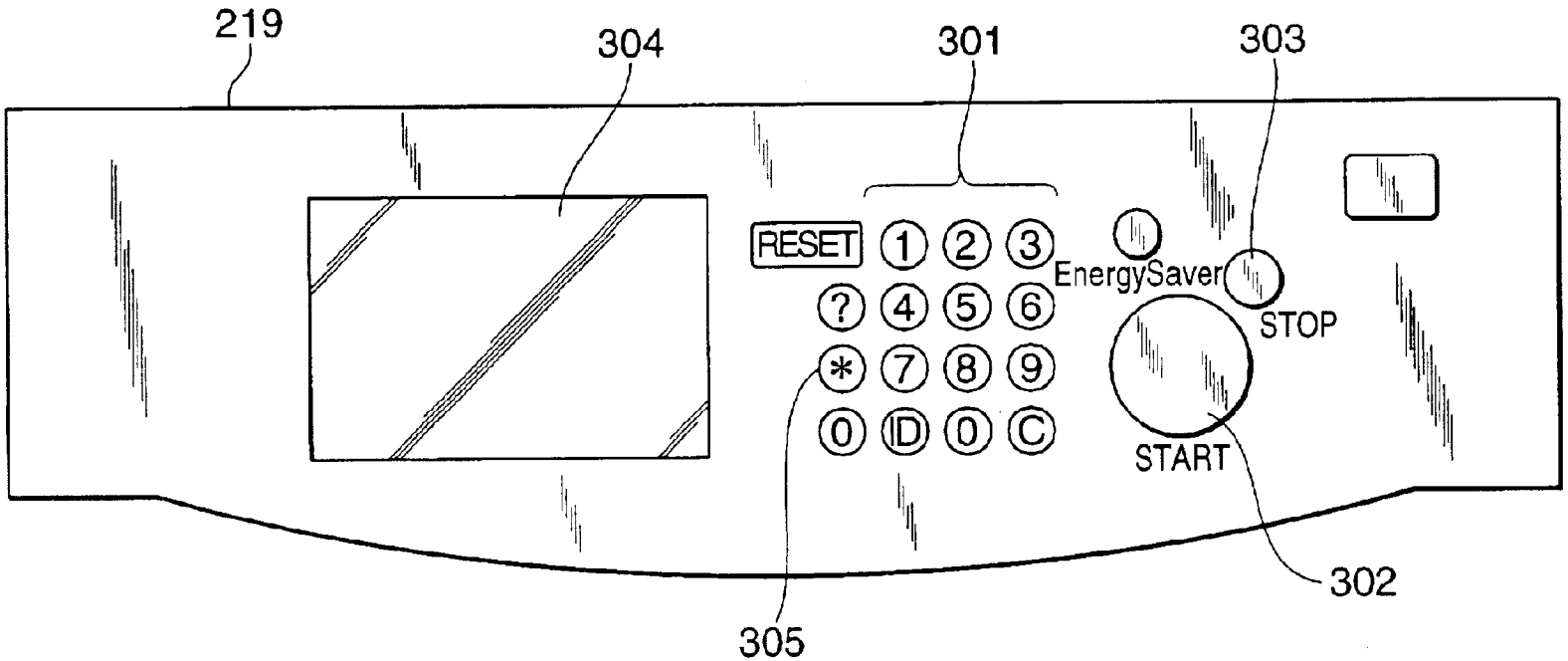
FIG. 3 is a view showing the panel layout of an operating section of the control circuit in FIG. 2.

FIG. 3 is a view showing the panel layout of the operating section 219 in the control circuit in FIG. 2. The operating section 219 is comprised of a numeric keypad 301, a start key 302, a stop key 303, an LCD (Liquid Crystal Display) 304, and a user mode key 305. The numeric keypad 301 is operated by the user to input the number of copies and the shift amount of an image to be copied. The start key 302 is depressed by the user to start a copy job. The stop key 303 is depressed by the user to interrupt the started job. The LCD 304 displays the operating condition of the image forming apparatus 100. The LCD 304 is provided with touch panel switches, which are operated by the user to set a mode for a copy job.

The user mode key 305 is depressed by the user to display a user mode screen on the LCD 304. The user can set the specifications of various functions of the image forming apparatus 100 via the user mode screen, and for example, the user can set standard operations of the image forming apparatus 1000, such as a setting of a mode selected as a standard mode in the case where the user does not designate one of an automatic color selection mode, a color image formation mode, or a black-and-white image formation mode, described later, a setting as to whether the lengths of a sheet in the vertical and horizontal directions are to be inputted or not in the case where a free size sheet is used in the black-and-white mode, or a setting as to whether the lengths of a sheet in the vertical and horizontal directions are to be inputted first or are to be inputted at a time point a color original is detected in the case where a free size sheet is used in the automatic color selection mode.

Figure 4:
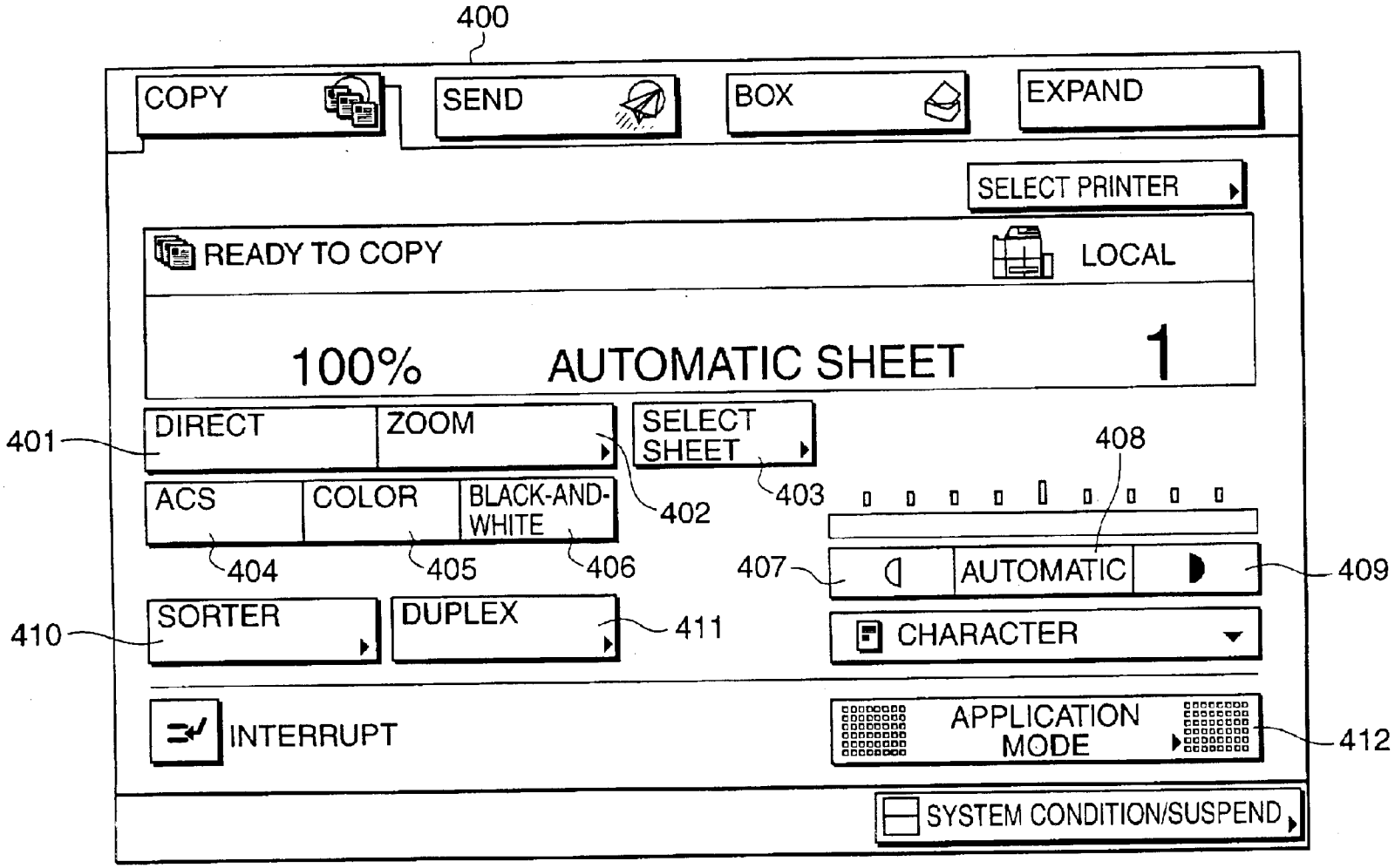
FIG. 4 is a view showing a standard screen of an LCD of the operating section in FIG. 3.

FIG. 4 is a view showing a screen displayed in the standard state of the LCD 304 on the operating section 219 in FIG. 3. On the screen 400 displayed in the standard state of the LCD 304, buttons 401 and 402 are for setting the magnification in image formation. A sheet selection button 403 is for setting the sizes of various types of sheets such as a regular size sheet and a free size sheet. Upon depression of the sheet selection button 403, a sheet selection screen, described later (FIG. 7), is displayed on the LCD 304.

Figure 5:
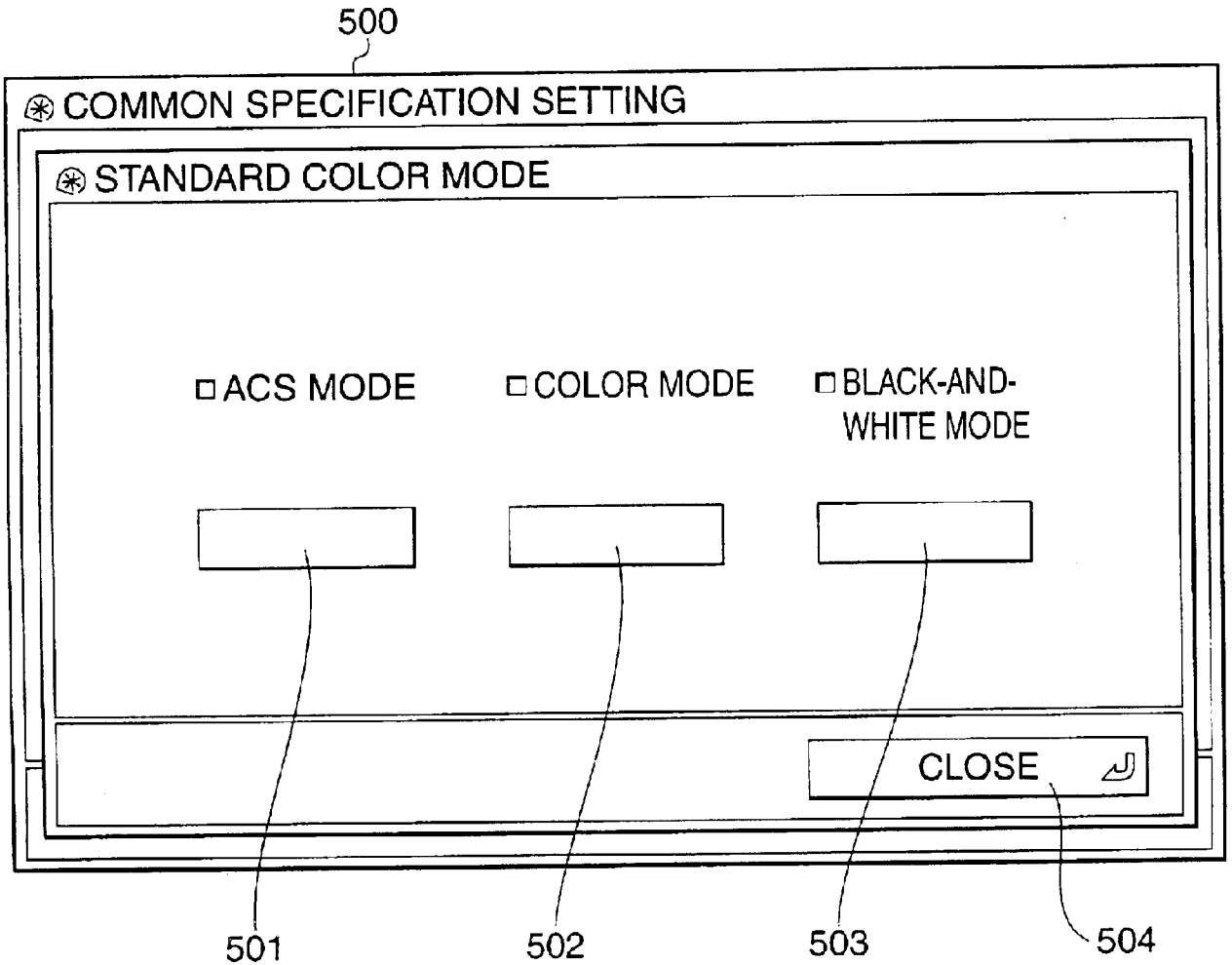
FIG. 5 is a view showing an example of display on a user mode screen that is displayed on the LCD upon depression of a user mode key in FIG. 3 and is selected as a standard screen to designate an image processing mode in the case where the user has not designated the image processing mode.

Buttons 404, 405, and 406 are for forming an image in the automatic color selection (ACS) mode (in which whether an image is to be formed in the color mode or in the black-and-white mode is determined for each sheet), the color mode, and the black-and-white mode, respectively. During image formation, if the user does not designate any of these modes, an image is formed in a mode which is set via a user mode screen, described later (FIG. 5). Buttons 407, 408, and 409 are for adjusting the print density of an image. A button 410 is for specifying processing such as stapling to be carried out on a bundle of sheets by a sheet discharge processing device, not shown. A button 411 is for specifying whether images are arranged from one side to one side, from one side to both sides, from both sides to one side, or from both sides to both sides when the images read from originals are formed on sheets. A button 412 is for designating various application modes.

FIG. 5 shows an example of the user mode screen, which is displayed on the LCD 304 upon depression of the user mode key 305 in FIG. 3, i.e. a display screen for designating the image processing mode serving as the standard image processing mode when the user does not designate the automatic color selection (ACS) mode, color mode, or black-and-white mode during image formation. On the display screen 500, the automatic color selection (ACS) mode is selected as the standard mode upon depression of a button 501, the color mode is selected as a standard mode upon depression of a button 502, and the black-and-white mode is selected as the standard mode upon depression of a button 503. After the selection, a button 504 is depressed to terminate the setting.

Figure 6:
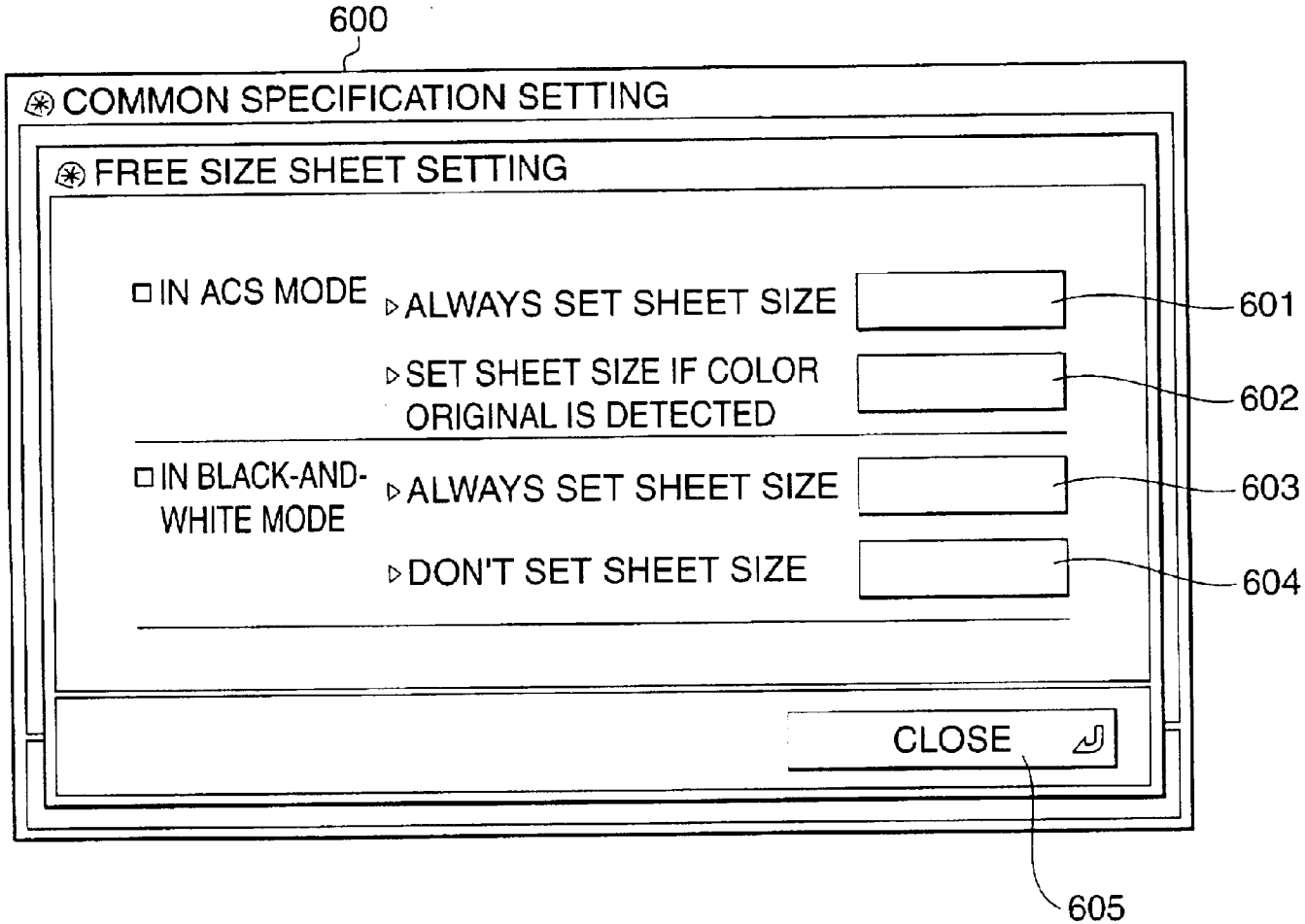
FIG. 6 is a view showing an example of display on the user mode screen that is displayed on the LCD upon depression of a user mode key in FIG. 3, the view showing a free size sheet setting method designating screen for designating the method of setting the length of a sheet in vertical and horizontal directions thereof when a free size sheet is selected.

FIG. 6 also shows an example of the user mode screen, which is displayed on the LCD 304 upon depression of the user mode key 305 in FIG. 3, i.e. a free size sheet setting method specifying screen for specifying how the lengths of a sheet in the vertical and horizontal directions are set in the case where a free size sheet is selected. On this free size sheet setting method specifying screen 600, there are made a setting as to whether the lengths of the free size sheet in the vertical and horizontal directions are to be necessarily or always set or to be set only when a color original is detected, in the case where a free size sheet has been selected in the automatic color selection (ACS) mode, and a setting as to whether the lengths of a free size sheet in the vertical and horizontal directions are to be set or not in the case where the free size sheet has been selected in the black-and-white mode.

If a button 601 has been depressed, the lengths of a free size sheet in the vertical and horizontal directions are necessarily set in the case where an image is formed on the free size sheet in the automatic color selection (ACS) mode, and if a button 602 has been depressed, the lengths of a sheet in the vertical and horizontal directions are set when a color original is detected during reading of originals, and the lengths of a sheet in the vertical and horizontal directions are not set when a color original is not detected. The buttons 601 and 602 are exclusively selected, and cannot be depressed at the same time. If a button 603 has been depressed, the lengths of a free size sheet in the vertical and horizontal directions are set in the case where an image is formed on the free size sheet in the black-and-white mode, but if a button 604 has been depressed, the lengths of a free size sheet in the vertical and horizontal directions are not set. The buttons 603 and 604 are also exclusively selected.

Figure 7:
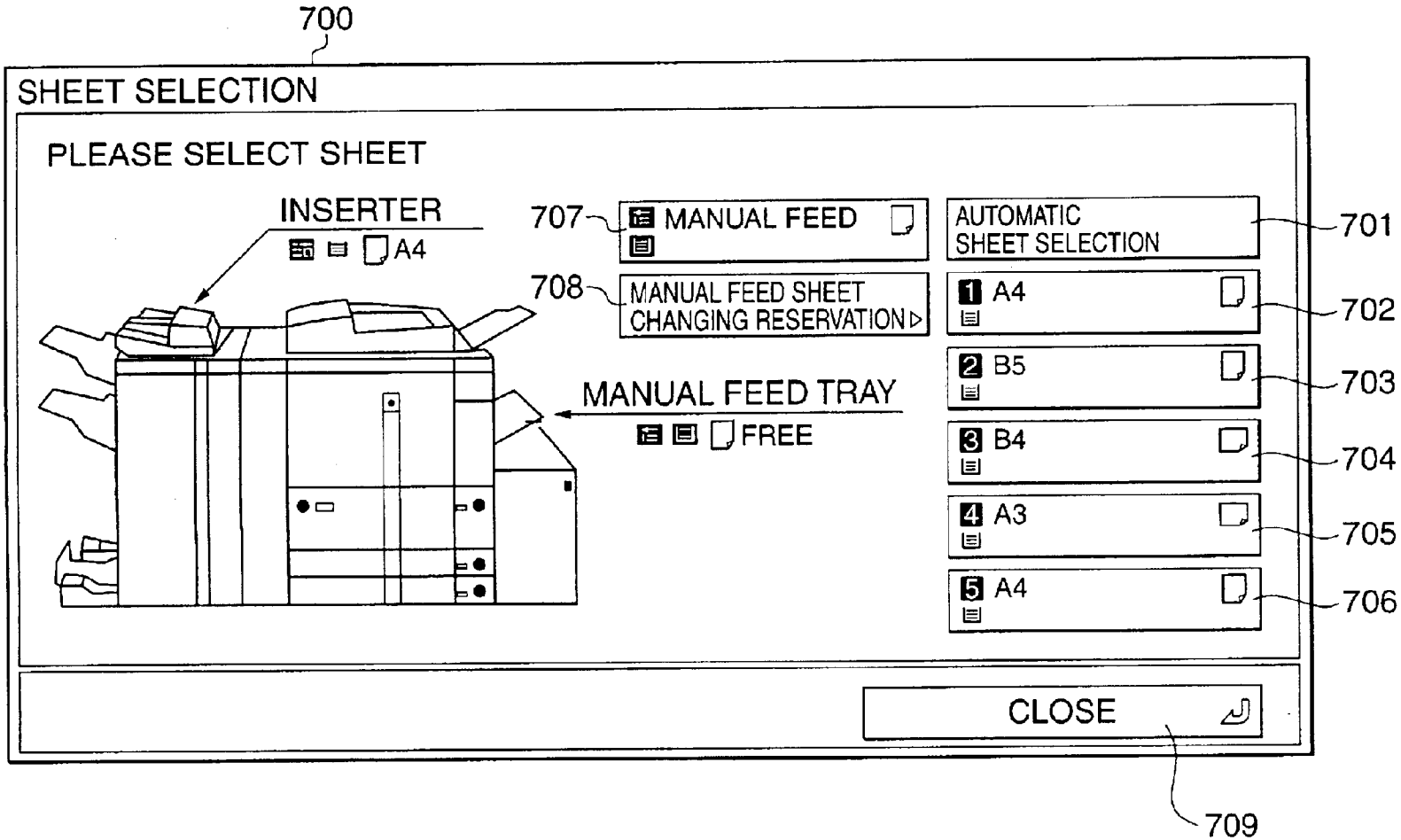
FIG. 7 is a view showing a sheet selection screen that is displayed upon depression of a sheet selection button on the display screen in FIG. 4.

FIG. 7 shows the sheet selection screen, which is displayed upon depression of the sheet selection button 403 on the display screen 400 in FIG. 4. If a free size sheet is selected on this sheet selection screen 700, a sheet is fed from the multi manual feed cassette 160 and thus, a manual sheet feed button 707 is depressed on the sheet selection screen 700. If a regular size sheet is selected, a desired sheet size is selected by depressing any of buttons 701 to 706. After the selection, a button 709 is depressed to complete the setting.

Figure 8:
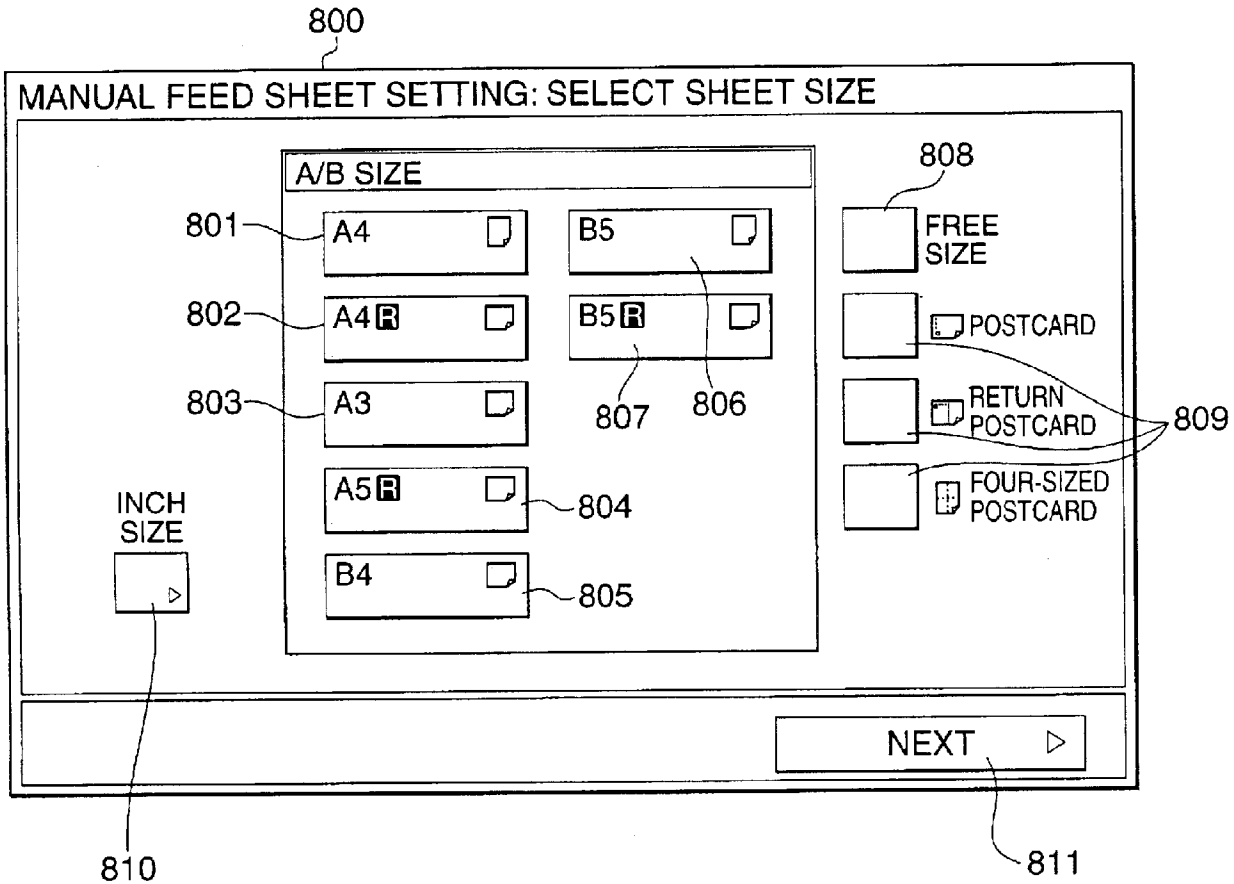
FIG. 8 is a view showing a manual feed sheet size selection screen that is displayed upon depression of a manual feed button on the sheet selection screen in FIG. 7 or upon setting of a sheet on a multi manual feed cassette.

FIG. 8 shows a manual feed sheet size selection screen, which is displayed upon depression of the manual feed button 707 on the sheet selection screen 700 in FIG. 7, or is displayed upon setting of a sheet or sheets on the multi manual feed cassette 160. On the manual feed sheet size selection screen 800, a free size button 808 is depressed when a free size sheet is fed from the multi manual feed cassette 160, and any of buttons 801 to 807 and 809 is depressed when a desired regular size sheet is fed. After the selection, a button 811 is depressed to display a manual feed sheet type selection screen (FIG. 9), described below, on the LCD 304.

Figure 9:
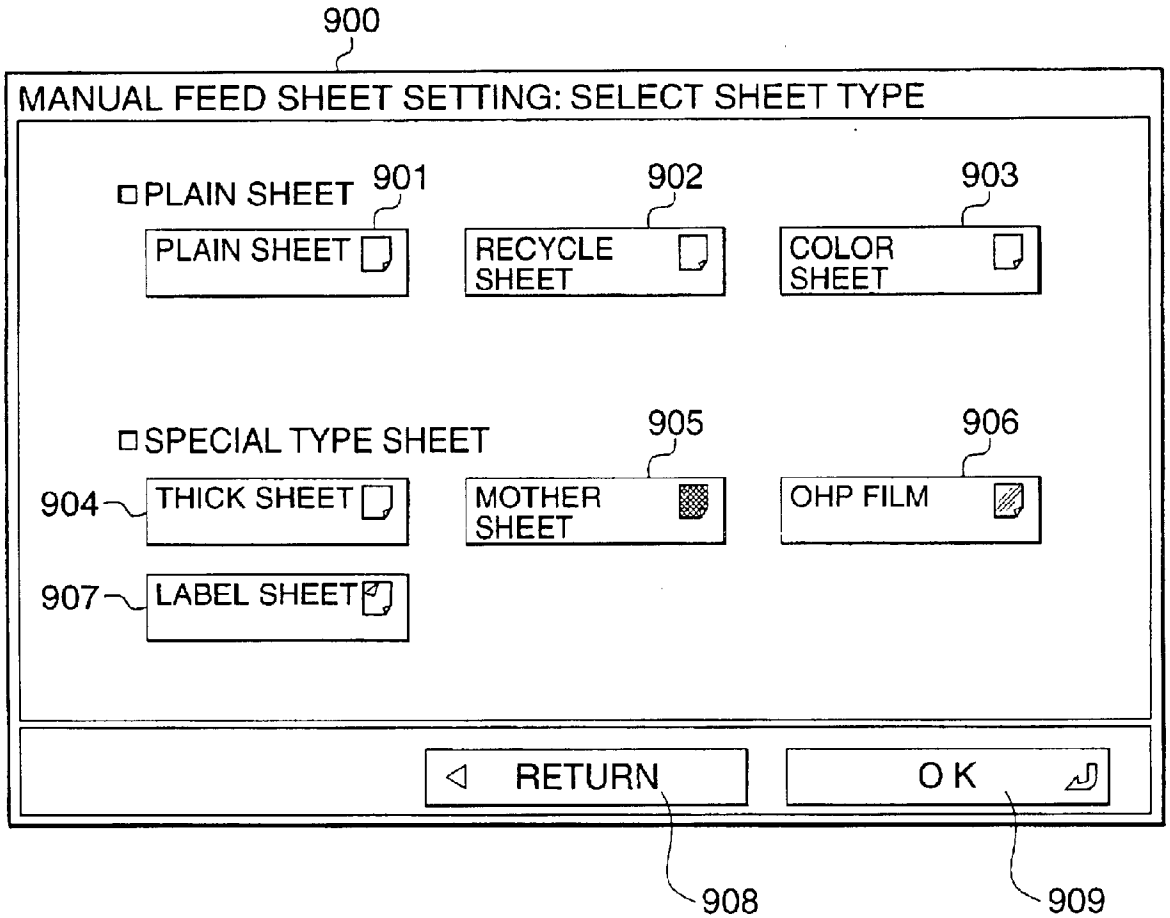
FIG. 9 is a view showing a manual feed sheet type selection screen that is displayed to select the type of a sheet to be fed from a manual feed cassette.

FIG. 9 shows the manual feed sheet type selection screen, which is displayed upon depression of the button 811 on the manual feed sheet size selection screen 800 in FIG. 8 to select the type of a sheet fed from the multi manual feed cassette 160. On the manual feed sheet type selection screen 900, any of buttons 901 to 907 is depressed to select the type of a sheet (such as a thick sheet, mother print, OHP film, or label sheet), and a button 909 is depressed to complete the setting.

Figure 10:
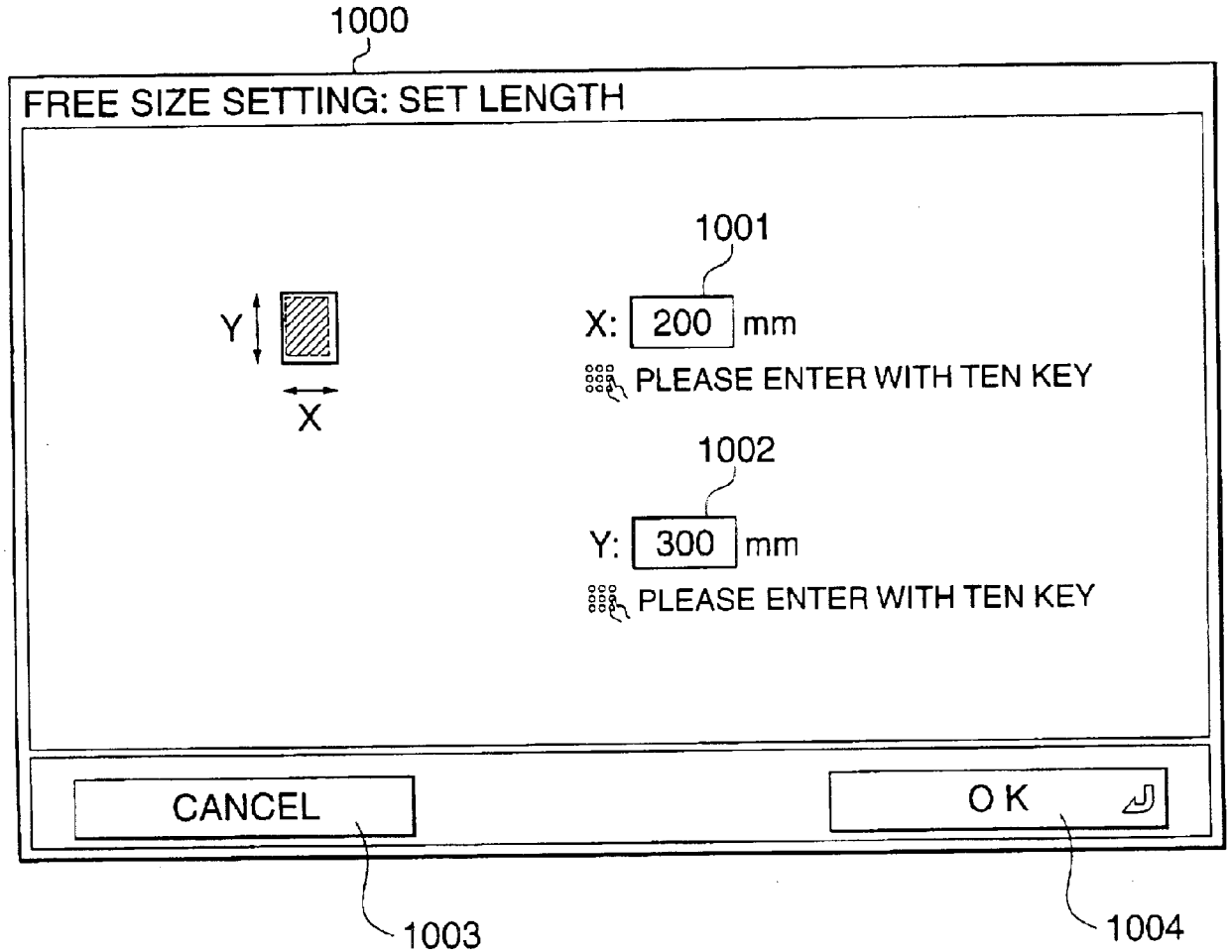
FIG. 10 is a view showing a display screen of the LCD in FIG. 3 that is displayed to designate the lengths of a free size sheet in vertical and horizontal directions thereof.

FIG. 10 shows a display screen, which is displayed on the LCD 304 in FIG. 3 to specify the lengths of a free size sheet in the vertical and horizontal directions. The display screen 1000 in FIG. 10 is displayed according to the setting made on the above described free size sheet setting method specifying screen (FIG. 6). Whenever an image is formed on a free size sheet in the case where no setting has been made on the free size sheet setting method specifying screen, the display screen 1000 is displayed to specify the lengths of the sheet in the vertical and horizontal directions. To set the length of a sheet in the horizontal direction, an entry button 1001 is depressed to input the length of the sheet through the operation of the numeric keypad 301 on the operating section 219 (FIG. 3). Similarly, to set the length of a sheet in the vertical direction, an entry button 1002 is depressed to input the length of the sheet through the operation of the numeric keypad 301. Incidentally, it may be configured that, when setting the length of a sheet in the vertical direction, the detected guide width of the multi manual feed cassette 160 is read so that the display screen 1000 is displayed with the detected guide width set in advance, and the user inputs the length of the sheet in the vertical direction only when the detected guide width is different from a desired setting value.

A description will now be given of how the main body controller 200 provides control according to the settings made by the user via the above described display screens on the operating section 219 of the image forming apparatus 100 with reference to flow charts of FIGS. 11 through 16. It should be noted that the main body controller 200 performs processing of each flow chart according to a program stored in its ROM.

Figure 11:
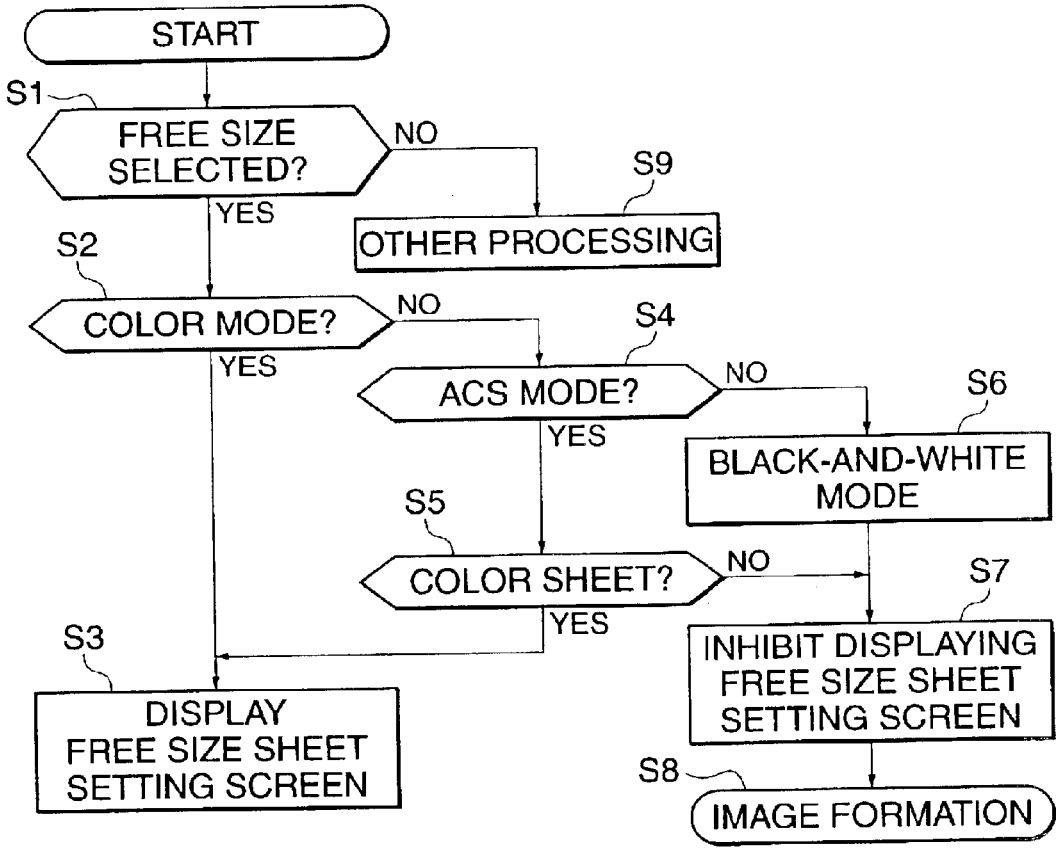
FIG. 11 is a flow chart of a first example of processing carried out based on operations carried out via a display screen of the operating section of the image forming apparatus according to the embodiment.

In FIG. 11, the main body controller 200 determines whether a free size sheet has been selected or not according to the setting made by the user via the display screens of the operating section 219 (step S1). If it is determined in the step S1 that a free size sheet has not been selected, other processing is carried out (step S9). On the other hand, if it is determined in the step S1 that a free size sheet has been selected, it is then determined whether the color mode has been designated or not (step S2). If the color mode has been designated ("YES" in the step S2), specifically, if the color mode has been designated in advance as the standard mode by depressing the button 502 on the display screen 500 in FIG. 5 and the user has not depressed the buttons 404 and 406 or has depressed the color mode button 405 on the display screen in the standard state shown in FIG. 4 when the image forming apparatus 100 forms an image on a sheet, the main body controller 200 provides control to display the screen 1000 (FIG. 10) for specifying the lengths of a free size sheet in the vertical and horizontal directions (step S3). If the color mode has not been designated ("NO" in the step S2), it is determined whether the ACS mode has been designated or not (step S4). If the ACS mode has been designated ("YES" in the step S4), specifically, if the ACS mode has been designated in advance as the standard mode by depressing the button 501 on the display screen 500 and the user has not depressed the buttons 405 and 406 has depressed the color mode button 404 on the display screen in the standard state shown in FIG. 4 when the image forming apparatus 100 forms an image on a sheet, an original is read, and it is determined whether the original is a color original or not (step S5). If a color original has been detected ("YES" in the step S5), the main body controller 200 provides control to display the screen 1000 for specifying the lengths of a free size sheet in the vertical and horizontal directions (step S3). On the other hand, if a color original has not been detected ("NO" in the step S5), an image is formed on the sheet (step S8) without displaying the screen 1000 for specifying the lengths of a free size sheet in the vertical and horizontal directions (step S7).

On the other hand, if neither the color mode nor the ACS mode has been designated ("NO" in the step S2 and step S4), it is determined that the black-and-white mode has been designated (step S6). Specifically, if the black-and-white mode has been designated in advance as the standard mode by depressing the button 503 on the display screen 500 and the user has not depressed the buttons 404 and 405 or has depressed the black-and-white mode button 406 on the display screen in the standard state in FIG. 4 when the image forming apparatus 100 forms an image on a sheet, the image is formed on the sheet (step S8) without displaying the screen 1000 for specifying the lengths of a free size sheet in the vertical and horizontal directions (step S7).

In this way, in the case where an image is formed on a free size sheet in the color mode, a request is given for setting the lengths of the free size sheet in the vertical and horizontal directions (step S3), and in the case where an image is formed on a free size sheet in the black-and-white mode, the image can be formed even without setting the lengths of the free size sheet in the vertical and horizontal directions (steps S7 and S8).

Figure 12:
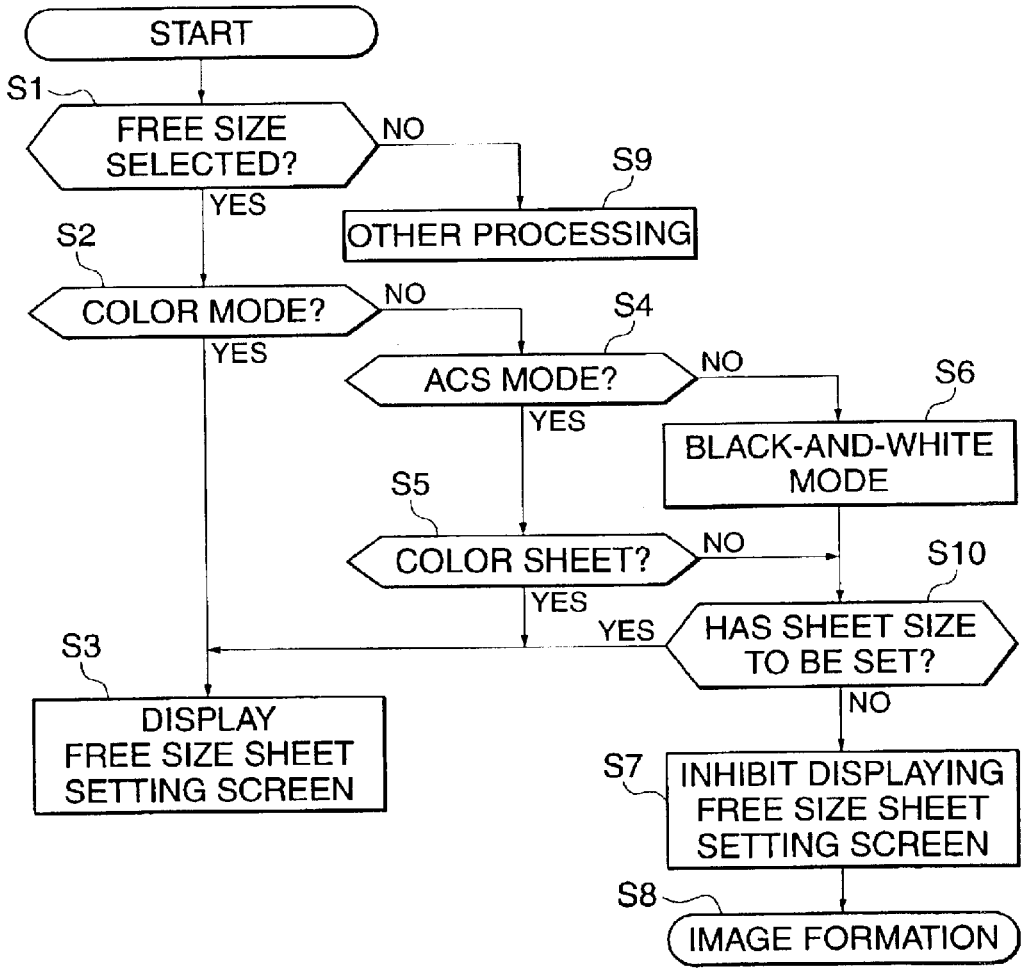
FIG. 12 is a flow chart of a second example of processing carried out based on operations carried out via a display screen of the operating section.

A flow chart of FIG. 12 shows the same processing as in FIG. 11, but further comprises a step of determining whether the lengths of a free size sheet in the vertical and horizontal directions are to be set or not according to the user mode settings (FIG. 6) when an image is formed on the free size sheet in the black-and-white mode (step S10). This is intended to require the user to set the lengths of the free size sheet even in the black-and-white mode to satisfy the requirements for the improved quality of a black-and-white image from the user who puts more emphasis on the quality of a black-and-white image than on the improvement of the usability in the case where it is requested to set the size of the free size sheet by depressing the button 603 on the free size sheet setting method specifying screen in FIG. 6. In FIG. 12, the same steps as those in FIG. 11 are designated by the same reference numerals, and description thereof is omitted. In FIG. 12, in the black-and-white mode (step S6), i.e. if the black-and-white mode has been designated in advance as the standard mode by depressing the button 503 on the display screen 500 and the user has not depressed the buttons 404 and 405 or has depressed the black-and-white mode button 406 on the display screen in the standard state in FIG. 4 when the image forming apparatus 100 forms an image on a sheet, the main body controller 200 determines whether a request has been given for setting the size of the free size sheet by depressing the button 603 on the free size sheet setting method specifying screen 600 (step S10). If the request has been given for setting the size of the free size sheet ("YES" in the step S10), the main body controller 200 provides control to display the screen 1000 for specifying the lengths of a free size sheet in the vertical and horizontal directions (step S3). On the other hand, if the request has not been given for setting the size of the free size sheet ("NO" in the step S10), the main body controller 200 provides control to inhibit the screen 1000 for specifying the lengths of a free size sheet in the vertical and horizontal directions from being displayed (step S7).

Figure 13:
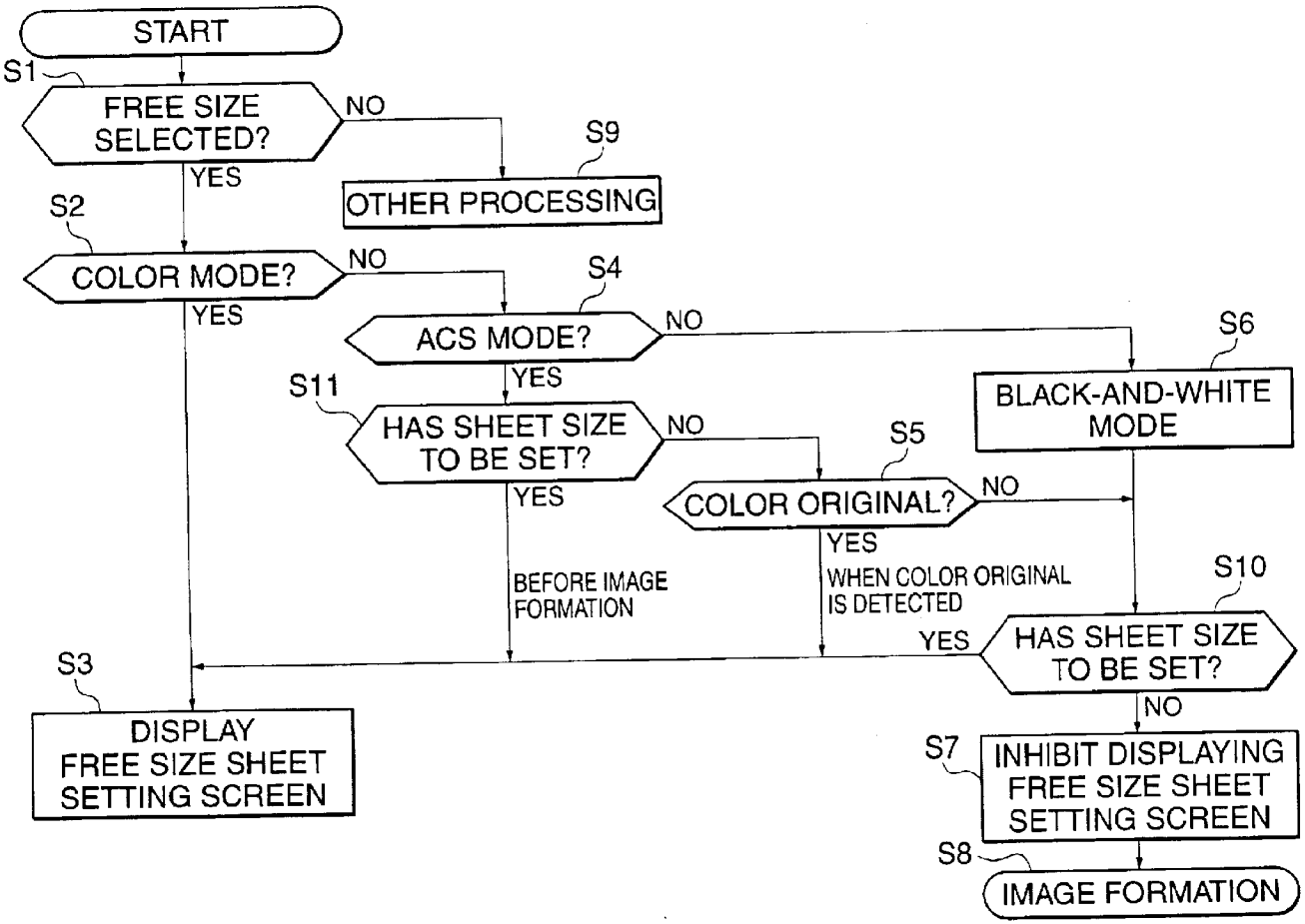
FIG. 13 is a flow chart of a third example of processing carried out based on operations carried out via a display screen of the operating section.

A flow chart of FIG. 13 shows the same processing as in FIG. 11, but further comprises the step of determining whether the lengths of a free size sheet in the vertical and horizontal directions are to be set or not according to the user mode settings (FIG. 6) when an image is formed on the free size sheet in the black-and-white mode (step S10), and a step of determining whether the lengths of a free size sheet in the vertical and horizontal directions are to be set or not according to the user mode settings (FIG. 6) irrespective of the type of an original when an image is formed on the free size sheet in the ACS mode (step S11). As is the case with FIG. 12, the flow chart of FIG. 13 is intended to require the user to set the size of the free size sheet even in the black-and-white mode to satisfy the requirements for the improved quality of a black-and-white image from the user who puts more emphasis on the image quality than on the improvement of the usability in the case where a request has been given for setting the size of the free size sheet by depressing the button 601 or 603 on the free size sheet setting method specifying screen 600 in FIG. 6. In FIG. 13, the same steps as those in FIGS. 11 and 12 are designated by the same reference numerals, and description thereof is omitted. In FIG. 13, if it is determined that the ACS mode has been designated ("YES" in the step S4), i.e. if the ACS mode has been designated in advance as the standard mode by depressing the button 501 on the display screen 500 and the user has not depressed the buttons 405 and 406 or has depressed the ACS mode button 404 on the display screen in the standard state in FIG. 4 when the image forming apparatus 100 forms an image on a sheet, the main body controller 200 determines whether a request has been given to set the size of the free size sheet by depressing the button 601 on the free size sheet setting method specifying screen 600 (step S11). If the request has been given to set the size of the free size sheet by depressing the button 601 ("YES" in the step S11), the main body controller 200 provides control to necessarily display the screen 1000 for specifying the lengths of a free size sheet in the vertical and horizontal directions before image formation (step S3). On the other hand, if the request has been given to set the size of the free size sheet by depressing the button 602 on the free size sheet setting method specifying screen 600 ("NO" in the step S11), the main body controller 200 provides control to display the screen 1000 for specifying the lengths of a free size sheet in the vertical and horizontal directions (step S3) at a time point a color original is detected during reading ("YES" in the step S5)

Figure 14:
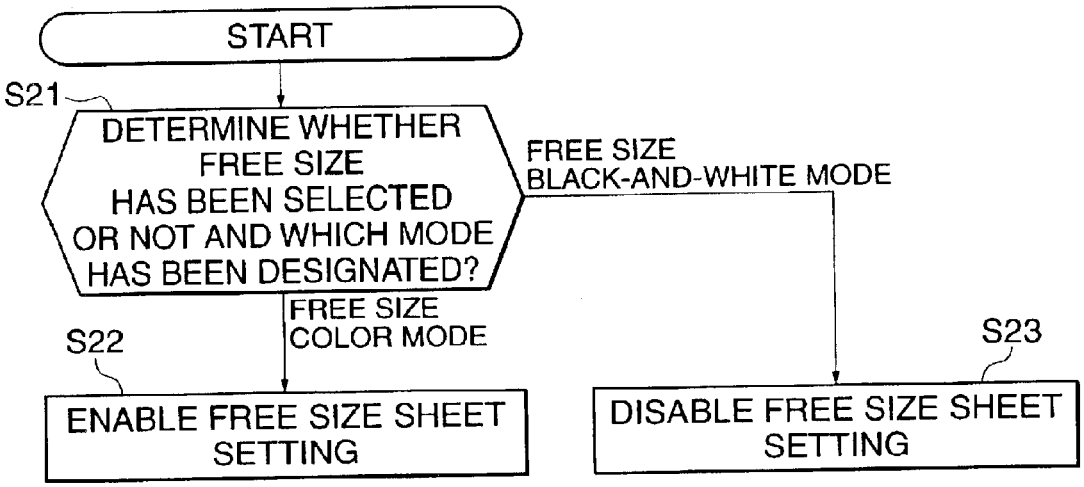
FIG. 14 is a flow chart of a fourth example of processing carried out based on operations carried out via a display screen of the operating section.

FIG. 14 shows the procedure in which the screen 1000 is controlled to be displayed in the color mode and is inhibited from being displayed in the black-and-white mode in the case where a free size sheet has been selected on the assumption that the image processing modes consist of only the color mode and the black-and-white mode. Specifically, the main body controller 200 determines whether a free size sheet has been selected or not and which image processing mode has been designated according to the settings made by the user via the displays screens of the operating section 219 (step S21). If a free size sheet has been selected by depressing the sheet selection button 403 on the display screen 400 in the standard state and the color mode has been designated by depressing the button 502 on the display screen 500, the main body controller 200 provides control to display the screen 1000 (FIG. 10) for specifying the lengths of a free size sheet in the vertical and horizontal directions (step S22). If a free size sheet has been selected by depressing the sheet selection button 403 and the black-and-white mode has been selected by depressing the button 503, the main body controller 200 provides control to inhibit the screen 1000 for specifying the lengths of a free size sheet in the vertical and horizontal directions from being displayed (step S23).

Figure 15:
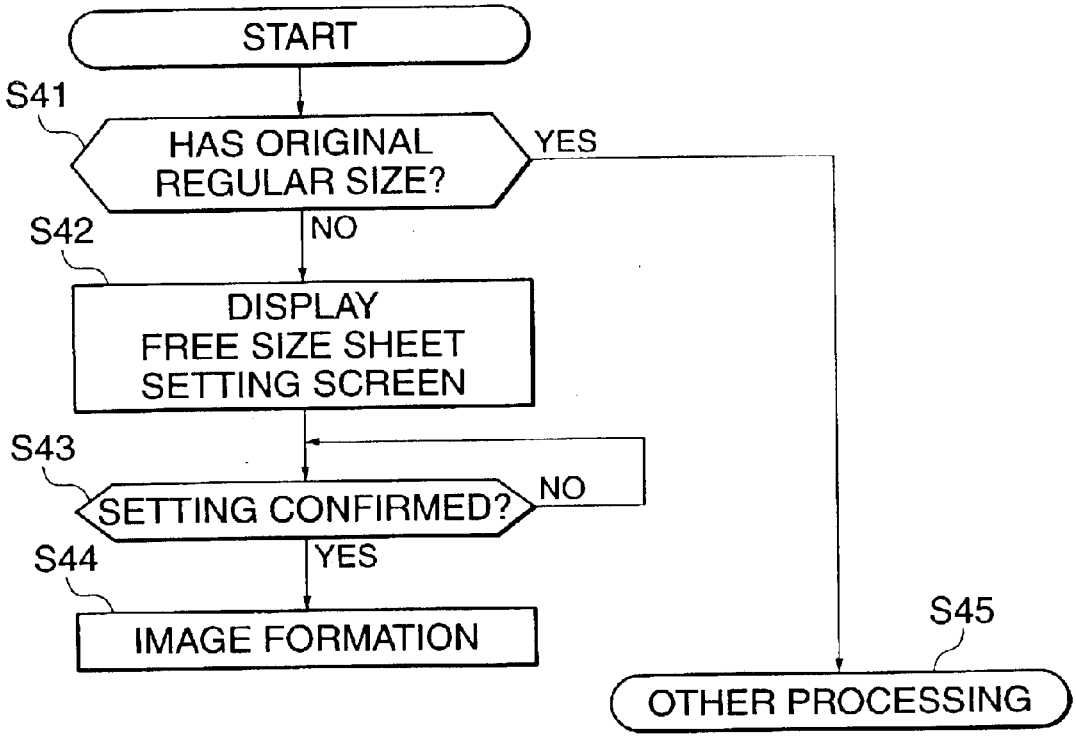
FIG. 15 is a flow chart of a fifth example of processing carried out based on operations carried out via a display screen of the operating section.

In FIG. 15, the main body controller 200 determines whether the size of an original is a regular size or not according to a detection signal supplied from the original size sensor 220 (step S41). If determining that the size of the original is not a regular size ("NO" in the step S41), the main body controller 200 provides control to display the screen 1000 for specifying the lengths of the free size sheet in the vertical and horizontal directions (step S42). Then it is determined whether the user has set the lengths of the free size sheet in the vertical and horizontal directions on the screen 1000 displayed in the step S42, and then has confirmed the setting (step S43). The processing in the step 43 is continued until confirmation of the setting by the user is made ("NO" in the step S43). On the other hand, if it is determined that the user has confirmed the setting by the user ("YES" in the step S43), the image forming section 110 carries out image formation (step S44).

On the other hand, if it is determined that the size of the original is a regular size ("YES" in the step S41), other processing is carried out (step S44).

Figure 16:
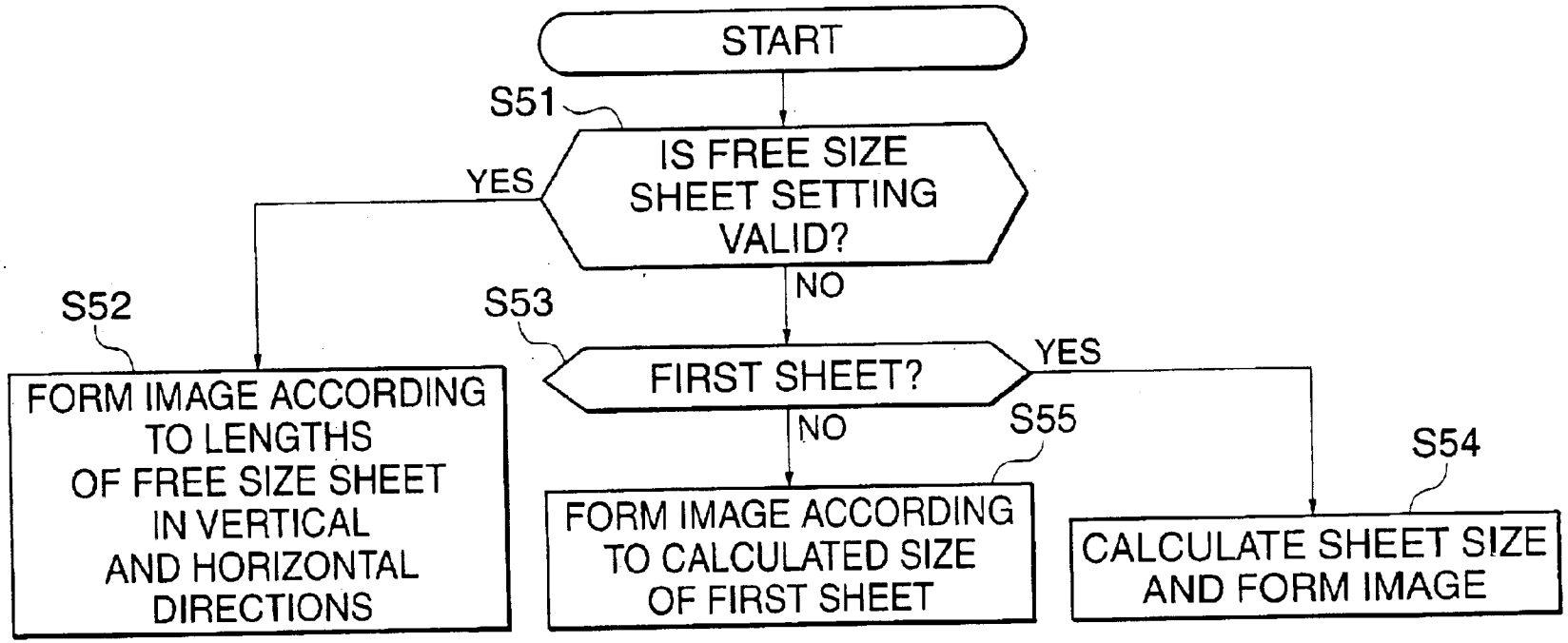
FIG. 16 is a flow chart of a sixth example of processing carried out based on operations carried out via a display screen of the operating section.

In FIG. 16, when an image is formed on a free size sheet in the black-and-white mode, the main body controller 200 determines whether a setting as to the size of a free size sheet is valid (i.e., whether the button 603 on the free size sheet setting method specifying screen 600 has been depressed) or invalid (i.e., whether the button 604 on the free size sheet setting method specifying screen 600 has been depressed) (step S51). If the setting as to the size of a free size sheet is valid ("YES" in the step S51), image formation is carried out according to the set lengths of the free size sheet in the vertical and horizontal directions (step S52). If the a setting as to the size of a free size sheet has been disabled ("NO" in the step S51), it is then determined whether the sheet is the first one (first sheet) or the second or subsequent one (step S53). If it is determined that the sheet is the first one ("YES" in the step S53), the sheet is detected by the sheet sensor 221 and the size thereof is calculated based on the detection result while the sheet is being fed, so that image formation is carried out according to the calculated sheet size (step S54). If the sheet is the second or subsequent one ("NO" in the step S53), image formation is carried out according to the sheet size of the first sheet calculated in the step S54 (step S55).

As described above, according to the present embodiment, in the image forming apparatus such as a copying machine having the color mode in which a color image is outputted and the black-and-white mode in which a black-and-white mode is outputted, when an image is formed on the free size sheet in the color mode, the lengths of a free size sheet in the vertical and horizontal directions are set, and when an image is formed on a free size sheet in the black-and-white mode, the image can be formed without setting the lengths of the free size sheet in the vertical and horizontal directions. This eliminates the necessity of performing such a complicated operation to input the lengths of a free size sheet in the vertical and horizontal directions in forming a black-and-white image on the free size sheet as in the prior art, thus reducing the burden on the user and improving the usability. Further, even if there are a large number of free size sheets on which black-and-white images are to be formed, prompt processing can be realized since the above complicated operation is not required.

Although in the above described embodiment, the image forming apparatus performs image formation based on electrophotography, the present invention is not limited to this. The present invention may be applied to a variety of image forming methods such as inkjet printing, electrostatic process copying, and thermal transfer process copying.

Further, although in the above described embodiment, the copying machine having the image reading function and the image forming function is employed as the image forming apparatus, the present invention is not limited to this. The present invention may be applied to a copying machine having an image reading function, image forming function, and image communicating function.

Further, although in the above described embodiment, the present invention is applied to the image forming apparatus as a single apparatus, the present invention is not limited to this, but the present invention may be applied to a system in which an arbitrary number of image forming apparatuses and an arbitrary number of electronic equipment such as information processing apparatuses such as a personal computer and imaging apparatuses such as a digital camera are connected to each other such that they may communicate with each other.

Further, the present invention may either be applied to a system composed of a plurality of apparatuses or to a single apparatus.

It is to be understood that the object of the present invention may also be accomplished by supplying a system or an apparatus with a storage medium in which a program code of software which realizes the functions of the above described embodiment is stored, and causing a computer (or CPU or MPU) of the system or apparatus to read out and execute the program code stored in the storage medium.

In this case, the program code itself read from the storage medium realizes the functions of the above described embodiment, and hence the program code and a storage medium on which the program code is stored constitute the present invention.

The storage medium for supplying the program code is not limited to a ROM, and a floppy (registered trademark) disk, a hard disk, an optical disk, a magnetic-optical disk, a CD-ROM, a CD-R, a CD-RW, a DVD-ROM, a DVD-RAM, a DVD-RW, a DVD+RW, a magnetic tape, a nonvolatile memory card, and a download carried out via a network may be used.

Further, it is to be understood that the functions of the above described embodiment may be accomplished not only by executing the program code read out by a computer, but also by causing an OS (operating system) or the like which operates on the computer to perform a part or all of the actual operations based on instructions of the program code.

Further, it is to be understood that the functions of the above described embodiment thereof may be accomplished by writing the program code read out from the storage medium into an expansion board inserted into a computer or a memory provided in an expansion unit connected to the computer and then causing a CPU or the like provided in the expansion board or the expansion unit to perform a part or all of the actual operations based on instructions of the program code.

What is claimed is:

1. An image forming apparatus comprising:

an image forming section capable of forming a color image and a black-and-white image on a sheet; and a controller;

wherein said controller is operable when a color image is formed on a free size sheet, for causing said image forming section to carry out color image formation according to a setting as to lengths of the free size sheet in vertical and horizontal directions thereof, and is operable when a black-and-white image is formed on a free size sheet, for causing said image forming section to carry out image formation even if no setting as to the lengths of the free size sheet in vertical and horizontal directions thereof is made.

2. An image forming apparatus according to claim 1, comprising:

a mode designating section that designates a color mode in which a color image is formed or a black-and-white mode in which a black-and-white image is formed;

a sheet selecting section that selects one of a regular size sheet and a free size sheet; and a free size setting section that sets the lengths of the free size sheet in vertical and horizontal directions thereof; and wherein said controller provides control to enable said free size setting section when the free size sheet has been selected and the color mode has been designated, and to disable said free size setting section when the free size sheet has been selected and the black-and-white mode has been designated.

3. An image forming apparatus according to claim 2, comprising:

an in-black-and-white mode specifying section operable when image formation is carried out on the free size sheet in the black-and-white mode designated by said mode designating section, for specifying whether the lengths of the free size sheet in the vertical and horizontal directions are to be set; and wherein said controller provides control to disable said free size setting section when said in-black-and-white mode specifying section specifies that the lengths of the free size sheet in the vertical and horizontal directions are not to be set, and to enable said free size setting section when said in-black-and-white mode specifying section specifies that the lengths of the free size sheet in the vertical and horizontal directions are to be set.

4. An image forming apparatus according to claim 2, comprising a determining section that determines whether an original is a color original or a black-and-white original; and wherein said mode designating section is capable of designating an automatic color selection mode in which whether image formation is carried out in the color mode or in the black-and-white mode is determined for each sheet;

said controller provides control to cause said color image forming section to form a color image when the automatic color selection mode has been designated and it has been determined that the original is the color original, to cause said image forming section to form a black-and-white image when the automatic color selection mode has been designated and it has been determined that the original is the black-and-white original, and to enable said free size setting section at a time point it is determined that the original is the color original when the automatic color selection mode has been designated and the free size sheet has been selected.

5. An image forming apparatus according to claim 4, comprising an in-automatic color selection mode specifying section operable when the automatic color selection mode has been designated and the free size sheet has been selected, for specifying whether said free size setting section is to be necessarily enabled before image formation or is to be enabled at a time point it is determined that the original is the color original.

6. An image forming apparatus according to claim 2, comprising an original size detecting section that detects a size of an original; and wherein said sheet selecting section selects the free size sheet when the size of the original is detected as being any other size than a regular size.

7. An image forming apparatus according to claim 6, wherein said original size detecting section is further capable of detecting lengths of the original in vertical and horizontal directions thereof; and wherein said controller provides control to display a screen for setting the lengths of the free size sheet in the vertical and horizontal directions thereof and perform image formation according to settings and confirmation made by a user when the original size has been detected as being any other size than the regular size.

8. An image forming apparatus according to claim 2, comprising:

a sheet detecting section that detects whether a sheet is present; and a sheet size calculating section that calculates a sheet size based on a detection result obtained by said sheet detecting section; and wherein, in a case where image formation is carried out on the free size sheet, said controller provides control such that the image formation is carried out according to the set lengths of the free size sheet in the vertical and horizontal directions thereof when said free size setting section has been enabled, and such that said sheet detecting section carries out sheet detection, said sheet size calculating section calculates the sheet size of a first sheet being fed, and the image formation is carried out on second and subsequent sheets according to the calculated sheet size when said free size setting section has been disabled.

9. A sheet setting control method for an image forming apparatus capable of forming a color image and a black-and-white image, comprising the steps of:

carrying out image formation according to a setting as to lengths of a free size sheet in vertical and horizontal directions thereof when a color image is formed on the free size sheet; and carrying out image formation even if no setting as to the lengths of the free size sheet in the vertical and horizontal directions thereof is made when a black-and-white image is formed on the free size sheet.

10. A sheet setting control method according to claim 9, comprising the steps of:

enabling a free size setting function of setting the lengths of a free size sheet in vertical and horizontal directions thereof when the free size sheet has been selected and a color mode in which a color image is formed has been designated; and disabling the free size setting function when the free size sheet has been selected and a black-and-white mode in which a black-and-white image is formed has been designated.

11. A sheet setting control method according to claim 10, comprising the steps of:

enabling the free size setting function when an in-black-and-white mode specifying function of specifying whether the lengths of the free size sheet in vertical and horizontal directions thereof are to be set when an image is formed on the free size sheet in the black-and-white mode is disabled in a case where the free size sheet has been selected and the black-and-white mode has been designated; and enabling the free size setting function when the in-black-and-white mode designating function is enabled.

12. A sheet setting control method according to claim 10, comprising the steps of:

forming a color image when an automatic color selection mode in which whether image formation is to be carried out in the color mode or in the black-and-white mode is determined for each sheet has been designated and it has been determined that an original is a color original;

forming a black-and-white image when the automatic color selection mode has been designated and it has been determined that the original is a black-and-white original; and enabling the free size setting function at a time point it is determined that the original is the color original when the automatic color selection mode has been designated and the free size sheet has been selected.

13. A sheet setting control method according to claim 12, comprising the step of specifying whether the free size setting function is to be necessarily enabled before image formation or is to be enabled at a time point it is determined that the original is the color original when the automatic color selection mode has been designated and the free size sheet has been selected.

14. A sheet setting control method according to claim 10, comprising the step of selecting the free size sheet when a size of the original is detected as being any other size than a regular size.

15. A sheet setting control method according to claim 14, comprising the step of displaying a screen for setting the lengths of the free size sheet in the vertical and horizontal directions thereof and carrying out image formation according to settings and confirmation made by a user when the size of the original has been detected as being any other size than the regular size.

16. A sheet setting control method according to claim 10, comprising the steps of carrying out image formation according to the set lengths of the free size sheet in the vertical and horizontal directions thereof when the free size setting function has been enabled, and carrying out sheet detection, calculating a sheet size of a first sheet being fed, and carrying out image formation on second and subsequent sheets according to the calculated sheet size when the free size setting function has been disabled, in a case where image formation is carried out on the free size sheet.

17. An image forming apparatus comprising:

an image forming section capable of forming a color image and a black-and-white image on a sheet; and a controller;

wherein said controller is operable when a color image is formed on a sheet, for causing said image forming section to carry out color image formation according to a setting as to a size of the sheet, and is operable when a black-and-white image is formed on a sheet, for causing said image forming section to carry out black-and-white image formation even if no setting as to the size of the sheet is made.

18. A sheet setting control method for an image forming apparatus capable of forming a color image and a black-and-white image, comprising steps of:

carrying out color image formation according to a setting as to a size of a sheet when a color image is formed on the sheet; and carrying out black-and-white image formation even if no setting as to the size of a sheet is made when a black-and-white image is formed on the sheet.

* * * * *